US007911427B2

(12) United States Patent
Chung et al.

(10) Patent No.: US 7,911,427 B2
(45) Date of Patent: Mar. 22, 2011

(54) VOLTAGE BASED DATA DRIVING CIRCUIT, LIGHT EMITTING DISPLAY USING THE SAME, AND METHOD OF DRIVING THE LIGHT EMITTING DISPLAY

(75) Inventors: Bo Yong Chung, Seoul (KR); Do Hyung Ryu, Suwon-si (KR); Oh Kyong Kwon, Seoul (KR)

(73) Assignees: Samsung Mobile Display Co., Ltd., Suwon-si, Gyeonggi-do (KR); IUCF-HYU Hanyang University, Seongdong-gu, Seoul (KR)

( * ) Notice: Subject to any disclaimer, the term of this patent is extended or adjusted under 35 U.S.C. 154(b) by 809 days.

(21) Appl. No.: 11/491,911

(22) Filed: Jul. 25, 2006

(65) Prior Publication Data

US 2007/0024543 A1 Feb. 1, 2007

(30) Foreign Application Priority Data

Aug. 1, 2005 (KR) ..... 10-2005-0070440

(51) Int. Cl.
*G09G 3/32* (2006.01)

(52) U.S. Cl. ..... 345/82; 315/169.3

(58) Field of Classification Search ..... 345/36, 345/39, 44–46, 74.1–83; 315/169.3; 313/463
See application file for complete search history.

(56) References Cited

U.S. PATENT DOCUMENTS 6,710,548 B2 3/2004 Kimura
6,806,497 B2 10/2004 Jo
6,809,706 B2 10/2004 Shimoda
6,859,193 B1 2/2005 Yumoto ..... 345/82
6,873,117 B2 3/2005 Ishizuka
6,897,619 B2 * 5/2005 Shimizu ..... 315/169.3
(Continued)

FOREIGN PATENT DOCUMENTS

EP 1 675 093 6/2006
(Continued)

OTHER PUBLICATIONS

In, Hai-Jung, et al., "A Novel Voltage-Programming Pixel with Current- Correction Method for Large-Size and High-Resolution AMOLEDs on Poly-Si Backplane", International Meeting on Information Display, IMID's '05 Digest, No. 286, pp. 901-904, (Jul. 23, 2005).

(Continued)

*Primary Examiner* — Chanh Nguyen
*Assistant Examiner* — Ram A Mistry
(74) *Attorney, Agent, or Firm* — Lee & Morse, P.C.

(57) ABSTRACT

A data driving circuit for driving pixels of a light emitting display to display images with uniform brightness may include a current sink that is capable of receiving, via a data line, a predetermined current from a pixel to enable the data driving circuit to generate a compensation voltage for the pixel. The compensation voltage may compensate for variations among the pixels of the display. Variations among the pixels may result from different electron mobilities and/or threshold voltages of transistors included in the pixels. The value of the predetermined current may be equal to or higher than a value of a minimum current employable by the pixel to emit light of maximum brightness. The maximum brightness of the pixel may correspond to a brightness emitted by the pixel when a highest one of a plurality of set gray scale voltages is applied to the pixel.

22 Claims, 12 Drawing Sheets

U.S. PATENT DOCUMENTS

| | | | | |
|---|---|---|---|---|
| 7,030,842 | B2 | 4/2006 | Ha et al. | |
| 7,113,156 | B2 | 9/2006 | Hashimoto | |
| 7,193,592 | B2 | 3/2007 | Nakamura | |
| 7,432,891 | B2 | 10/2008 | Fruehauf | |
| 7,542,031 | B2 * | 6/2009 | Jo et al. | 345/211 |
| 2002/0109655 | A1 * | 8/2002 | Yer et al. | 345/87 |
| 2003/0122745 | A1 * | 7/2003 | Miyazawa | 345/76 |
| 2004/0056852 | A1 * | 3/2004 | Shih et al. | 345/204 |
| 2004/0222953 | A1 * | 11/2004 | Smith | 345/87 |
| 2004/0227749 | A1 * | 11/2004 | Kimura | 345/211 |
| 2005/0088103 | A1 | 4/2005 | Kageyama et al. | |
| 2008/0030438 | A1 | 2/2008 | Marx et al. | |

FOREIGN PATENT DOCUMENTS

| | | | |
|---|---|---|---|
| JP | 10-254410 | A | 9/1998 |
| JP | 2002-311898 | A | 10/2002 |
| JP | 2003-043993 | A | 2/2003 |
| JP | 2003-058106 | A | 2/2003 |
| JP | 2003-140613 | A | 5/2003 |
| JP | 2003-295828 | A | 10/2003 |
| JP | 2004-004675 | A | 1/2004 |
| JP | 2004-125852 | A | 4/2004 |
| JP | 2004-145197 | A | 5/2004 |
| JP | 2004-163673 | A | 6/2004 |
| JP | 2004-192000 | A | 7/2004 |
| JP | 2004-287345 | A | 10/2004 |
| JP | 2007-536585 | T | 12/2007 |
| KR | 10-2003-0081080 | | 10/2003 |
| KR | 10-2004-0061902 | | 7/2004 |

OTHER PUBLICATIONS

Matsueda, Yojiro, et al., "6-Bit Amoled with RGB Adjustable Gamma Compensation LTPS TFT Circuit", 2005 SID International Symposium Digest of Technical Papers, SID 05 Digest, Book II, vol. 36, pp. 1352-1355, (May 24-27, 2005).

* cited by examiner

VOLTAGE BASED DATA DRIVING CIRCUIT, LIGHT EMITTING DISPLAY USING THE SAME, AND METHOD OF DRIVING THE LIGHT EMITTING DISPLAY

BACKGROUND

1. Field of the Invention

The present invention relates to a data driving circuit, a light emitting display employing such a data driving circuit, and a method of driving the light emitting display. More particularly, the invention relates to a data driving circuit capable of displaying images with uniform brightness, a light emitting display using such a data driving circuit, and a method of driving the light emitting display to display images with uniform brightness.

2. Discussion of Related Art

Flat panel displays (FPDs), which are generally lighter and more compact than cathode ray tubes (CRTs), are being developed. FPDs include liquid crystal displays (LCDs), field emission displays (FEDs), plasma display panels (PDPs) and light emitting displays.

Light emitting displays may display images using organic light emitting diodes (OLEDs) that generate light when electrons and holes re-combine. Light emitting displays generally have fast response times and consume relatively low amounts of power.

FIG. 1 illustrates a schematic of the structure of a known light emitting display.

As shown in FIG. 1, the light emitting display includes a pixel unit 30, a scan driver 10, a data driver 20 and a timing controller 50. The pixel unit 30 may include a plurality of pixels 40 connected to scan lines S1 to Sn and data lines D1 to Dm. The scan driver 10 may drive the scan lines S1 to Sn. The data driver 20 may drive the data lines D1 to Dm. The timing controller 50 may control the scan driver 10 and the data driver 20.

The timing controller 50 may generate data driving control signals DCS and scan driving control signals SCS based on externally supplied synchronizing signals (not shown). The data driving control signals DCS are supplied to the data driver 20 and the scan driving control signals SCS are supplied to the scan driver 10. The timing controller 50 may supply data DATA to the data driver 20 in accordance with externally supplied data (not shown).

The scan driver 10 receives the scan driving control signals SCS from the timing controller 50. The scan driver 10 generates scan signals (not shown) based on the received scan driving control signals SCS. The generated scan signals may be sequentially supplied to the pixel unit 30 via the scan lines S1 to Sn.

The data driver 20 receives the data driving control signals DCS from the timing controller 50. The data driver 20 generates data signals (not shown) based on the received data DATA and data driving control signals DCS. Corresponding ones of the generated data signals may be supplied to the data lines D1 to Dm in synchronization with respective ones of the scan signals being supplied to the scan lines S1 to Sn.

The pixel unit 30 may be connected to a first power source ELVDD for supplying a first voltage VDD and a second power source ELVSS for supplying a second voltage VSS to the pixels 40. The pixels 40, together with the first voltage VDD signal and the second voltage VSS signal, control the currents that flow through respective OLEDs in accordance with the corresponding data signals. The pixels 40 thereby generate light based on the first voltage VDD signal, the second voltage VSS signal and the data signals.

In known light emitting displays, each of the pixels 40 may include a pixel circuit including at least one transistor for selectively supplying the respective data signal and the respective scan signal for selectively turning on and turning off the respective pixel 40 of the light emitting display.

It is desired for each pixel 40 of a light emitting display to generate light of predetermined brightness in response to various values of the respective data signals. For example, when the same data signal is applied to all the pixels 40 of the display, it is generally desired for all the pixels 40 of the display to generate the same brightness. The brightness generated by each pixel 40 is not, however, only dependent on the data signal. The brightness generated by each pixel 40 is also dependent on characteristics of each pixel 40, such as the characteristics, e.g., threshold voltage, of each transistor of the pixel circuit.

Generally, there are variations in threshold voltage and/or electron mobility from transistor to transistor such that different transistors have different threshold voltages and electron mobilities. The characteristics of transistors may also change over time and/or usage. For example, the threshold voltage and electron mobility of a transistor may be dependent on the on/off history of the transistor.

Therefore, in a light emitting display, the brightness generated by each pixel in response to respective data signals depends on the characteristics of the transistor(s) that may be included in the respective pixel circuit. Such variations in threshold voltage and electron mobility may prevent and/or hinder the uniformity of images being displayed. Thus, such variations in threshold voltage and electron mobility may also prevent the display of an image with a desired brightness.

Although it may be possible to at least partially compensate for differences between threshold voltages of the transistors included in the pixels by controlling the structure of the pixel circuits of the pixels 40, circuits and methods capable of compensating for the variations in electron mobility are needed and desired. OLEDs that are capable of displaying images with uniform brightness irrespective of variations in electron mobility are also desired.

SUMMARY OF THE INVENTION

The present invention is therefore directed to a data driving circuit and a light emitting display using the same, which substantially overcome one or more of the problems due to the limitations and disadvantages of the related art.

It is therefore a feature of an embodiment of the present invention to provide a data driving circuit capable of driving pixels of a light emitting display to display images with uniform brightness, a light emitting display using the same, and a method of driving the light emitting display.

At least one of the above and other features and advantages of the present invention may be realized by providing a data driving circuit for driving at least one pixel of a light emitting display based on externally supplied data for the pixel, wherein the pixel is electrically connectable to the driving circuit via at least one data line. The data driving circuit may include at least one current sink that may receive a predetermined current from the pixel via the data line, a voltage generator that may respectively set values of a plurality of gray scale voltages based on a compensation voltage generated by the pixel when the predetermined current flows through the pixel, at least one digital-analog converter that may select, as a data signal for the pixel, one of the plurality of set gray scale voltages based on a bit value of a portion of the externally supplied data associated with the pixel, at least one switching unit that may supply the selected data signal to the data line. A value of the predetermined current may be equal to or higher than a value of a minimum current employable by the pixel to emit light of maximum brightness. The maximum brightness may correspond to a brightness of the pixel when a highest one of the plurality of set gray scale voltages is applied to the pixel.

The voltage generator may include a plurality of voltage dividing resistors between a first terminal for receiving a reference power source and a second terminal for receiving the compensation voltage to set the gray scale voltages. A compensation resistor may be connected between the second terminal and the voltage dividing resistors to reduce a value of the compensation voltage. The compensation resistor may compensate for the value of the predetermined current being higher than the value of the minimum current employable by the pixel to emit light of maximum brightness by reducing the value of the compensation voltage such that a voltage corresponding to the minimum current may be supplied to the voltage dividing resistors. The current sink may receive the predetermined current from the pixel during a first partial period of one complete period for driving the pixel based on the selected gray scale voltage, the first partial period may occur before a second partial period in the one complete period for driving the pixel.

The current sink may include a current source for receiving the predetermined current, a first transistor between the data line and the voltage generator, the first transistor may be turned on during the first partial period, a second transistor between the data line and the current source, the second transistor may be turned on during the first partial period, and a capacitor that may charge the compensation voltage. The switching unit may include at least one transistor that may selectively connect the data line and the digital-analog converter to each other only during any partial period of a complete period, for driving the pixel based on the selected gray scale voltage, which occurs after a first partial period of the complete period. The switching unit may include two transistors that are connected to each other so as to form a transmission gate. The data driving circuit may include a first buffer provided between the digital-analog converter and the switching unit and/or a second buffer provided between the current sink and the voltage generator.

Each channel of the data driving circuit may include a respective one of each of the current sink, the voltage generator, the digital-analog converter and the switching unit. The data driving circuit may include at least one shift register for generating sampling pulses, at least one sampling latch for receiving the data in response to the sampling pulses, and at least one holding latch for temporarily storing the data stored in the sampling latch before the temporarily stored data is supplied to the digital-analog converter. The data driving circuit may include a level shifter for modifying a voltage level of the data stored in the holding latch before the temporarily stored data is supplied to the digital-analog converter.

At least one of the above and other features and advantages of the present invention may be separately realized by providing a light emitting display including a pixel unit including a plurality of pixels connected to n scan lines, a plurality of data lines, a plurality of emission control lines, a scan driver for respectively and sequentially supplying, during each scan cycle, n scan signals to the n scan lines, and for sequentially and respectively supplying emission control signals to the plurality of emission control lines, and a data driving circuit, the data driving circuit respectively setting values of and generating a plurality of gray scale voltages based on respective compensation voltages generated by flowing respective predetermined currents to the data lines during a first partial period of one combined period for driving at least one of the pixels, wherein respective values of the predetermined currents are equal to or greater than a value of a minimum current employable by the respective pixel to emit light of maximum brightness.

Each of the pixels may be connected to two of the n scan lines, and during each of the scan cycles, a first scan line of the two scan lines may receive a respective one of the n scan signals before a second scan line of the two scan lines receives a respective one of the n scan signals, and each of the pixels may include a first power source, an organic light emitting diode the organic light emitting diode receiving current from the first power source, first and second transistors, each of which may have a first electrode connected to the respective one of the data lines associated with the pixel, the first and second transistors may be turned on when the first of the two scan signals is supplied, a third transistor having a first electrode connected to a reference power source and a second electrode connected to a second electrode of the first transistor, the third transistor may be turned on when the first of the two scans signal is supplied, a fourth transistor, the fourth transistor may control an amount of current supplied to the organic light emitting diode, a first terminal of the fourth transistor may be connected to the first power source, and a fifth transistor having a first electrode connected to a gate electrode of the fourth transistor and a second electrode connected to a second electrode of the fourth transistor, the fifth transistor may be turned on when the first of the two scan signals is supplied such that the fourth transistor may operate as a diode.

Each of the pixels may include a first capacitor having a first electrode connected to one of a second electrode of the first transistor and the gate electrode of the fourth transistor and a second electrode connected to the first power source, and a second capacitor having a first electrode connected to the second electrode of the first transistor and a second electrode connected to the gate electrode of the fourth transistor.

Each of the pixels may include a sixth transistor having a first terminal connected to the second electrode of the fourth transistor and a second terminal connected to the organic light emitting diode, the sixth transistor may be turned off when the respective emission control signal is supplied. The current sink may receive the predetermined current from the pixel during the first partial period of one complete period for driving the pixel based on the selected gray scale voltage, the first partial period occurring before a second partial period in the complete period for driving the pixel, and the sixth transistor may be turned on during the second partial period of the complete period for driving the pixel.

At least one of the above and other features and advantages of the present invention may be separately realized by providing a method of driving at least one pixel of a light emitting display based on externally supplied data for the pixel, wherein the pixel may be electrically connectable to a driving circuit via at least one data line. The method may involve flowing a predetermined current from the pixel to a current sink of the light emitting display via the data line, a value of the predetermined current being equal to or greater than a value of a minimum current employable by the pixel to emit light of maximum brightness, generating a compensation voltage when the predetermined current flows through the pixel, setting values of and generating a plurality of gray scale voltages based on the generated compensation voltage, selecting, as a data signal for the pixel, one of the plurality of gray scale voltages based on a bit value of a portion of the externally supplied data associated with the pixel, and supplying the selected data signal to the pixel via the data line, wherein the maximum brightness may correspond to a brightness of the pixel when a highest one of the plurality of reset gray scale voltages is applied to the pixel.

Flowing the predetermined current and generating the compensation voltage may occur during a first partial period of a complete period for driving the pixel based on the selected gray scale voltage. Supplying the selected data signal may occur during any partial period of the complete period, for driving the pixel, other than the first partial period that occurs after the first partial period. When the value of the predetermined current flowing from the respective pixel to the current sink of the light emitting display is greater than the value of the minimum current employable by the respective pixel to emit light of maximum brightness, the step of generating the compensation voltage may include generating an initial compensation voltage and a first compensation voltage based on the initial compensation voltage before the step of setting values of the plurality of gray scale voltages. The first compensation voltage may be less than the initial generated compensation voltage and the first compensation voltage may correspond to a highest one of the plurality of gray scale voltages and the compensation voltage generated when the predetermined current that flows is equal to or substantially equal to the minimum current employable by the pixel to emit light of maximum brightness. Setting values of the plurality of gray scale voltages may include supplying the compensation voltage to a plurality of voltage dividing resistors.

At least one of the above and other features and advantages of the present invention may be separately realized by providing a data driving circuit employable by a light emitting display for driving at least one pixel of the light emitting display based on externally supplied data for the pixel, the pixel may be electrically connectable to at least one data line, at least one scan line and at least one emission line of the light emitting display. The data driving circuit may include means for sinking a predetermined current flowing through the pixel via the data line during a first partial period of a complete period based on the selected gray scale voltage, means for generating a compensation voltage using the predetermined current, means for generating and setting values for a plurality of gray scale voltages based on the compensation voltage generated by the pixel when the predetermined current flows through the pixel, means for selecting, as a data signal for the pixel, one of the plurality of set gray scale voltages based on a bit value of a portion of the externally supplied data associated with the pixel, and means for supplying the selected data signal to the data line, wherein a value of the predetermined current may be equal to or higher than a value of a minimum current employable by the pixel to emit light of maximum brightness, and the maximum brightness may correspond to a brightness of the pixel when a highest one of the plurality of set gray scale voltages is applied to the pixel.

BRIEF DESCRIPTION OF THE DRAWINGS

These and other features and advantages of the invention will become apparent to those of ordinary skill in the art by describing in detail exemplary embodiments thereof with reference to the attached drawings in which.

DETAILED DESCRIPTION OF EXEMPLARY EMBODIMENTS

Figure 1:
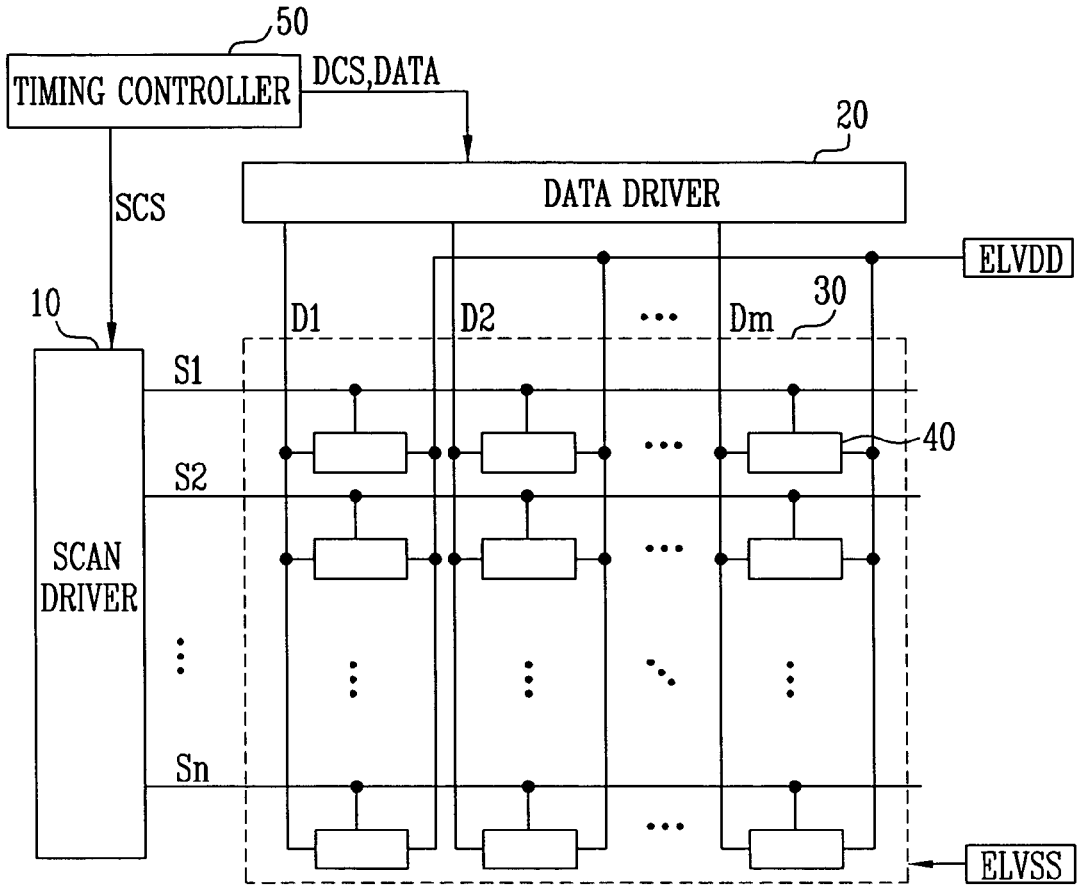
FIG. 1 (RELATED ART)
FIG. 1 illustrates a schematic diagram of a known light emitting display.

Korean Patent Application No. 2005-0070440, filed on Aug. 1, 2005, in the Korean Intellectual Property Office, and entitled: "Data Driving Circuit, Light Emitting Display Using the Same, and Method of Driving the Light Emitting Display," is incorporated by reference herein in its entirety.

The present invention will now be described more fully hereinafter with reference to the accompanying drawings, in which exemplary embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

Hereinafter, exemplary embodiments of the present invention will be described with reference to FIGS. 2 to 13.

Figure 2:
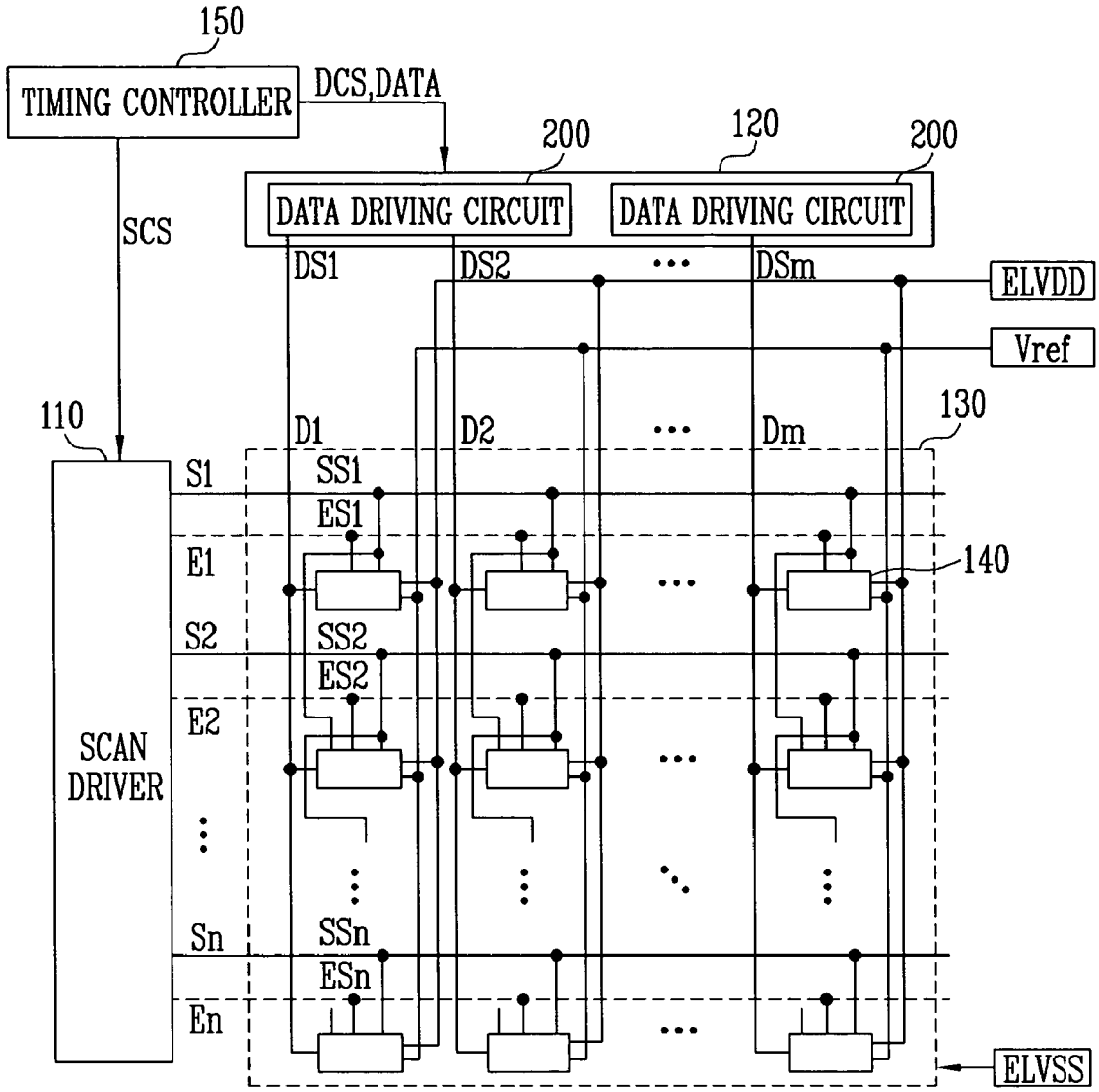
FIG. 2 illustrates a schematic diagram of a light emitting display according to an embodiment of the present invention.

FIG. 2 illustrates a schematic diagram of a light emitting display according to an embodiment of the present invention.

As shown in FIG. 2, the light emitting display may include a scan driver 110, a data driver 120, a pixel unit 130 and a timing controller 150. The pixel unit 130 may include a plurality of pixels 140. The pixel unit 130 may include n×m pixels 140 arranged, for example, in n rows and m columns, where n and m may each be integers. The pixels 140 may be connected to scan lines S1 to Sn, emission control lines E1 to En and data lines D1 to Dm. The pixels 140 may be respectively formed in the regions partitioned by the emission control lines En1 to En and the data lines D1 to Dm. The scan driver 110 may drive the scan lines S1 to Sn and the emission control lines E1 to En. The data driver 120 may drive the data lines D1 to Dm. The timing controller 150 may control the scan driver 110 and the data driver 120. The data driver 120 may include one or more data driving circuits 200.

The timing controller 150 may generate data driving control signals DCS and scan driving control signals SCS in response to externally supplied synchronizing signals (not shown). The data driving control signals DCS generated by the timing controller 150 may be supplied to the data driver 120. The scan driving control signals SCS generated by the timing controller 150 may be supplied to the scan driver 110. The timing controller 150 may supply data DATA to the data driver 120 in accordance with the externally supplied data (not shown).

The scan driver 110 may receive the scan driving control signals SCS from the timing controller 150. The scan driver 110 may generate scan signals SS1 to SSn based on the received scan driving control signals SCS and may sequentially and respectively supply the scan signals SS1 to SSn to the scan lines S1 to Sn. The scan driver 110 may sequentially supply emission control signals ES1 to ESn to the emission control lines E1 to En. Each of the emission control signals ES1 to ESn may be supplied, e.g., changed from a low voltage signal to a high voltage signal, such that an "on" emission control signal, e.g., a high voltage voltage signal, at least partially overlaps at least two of the scan signals SS1 to SSn. Therefore, in embodiments of the invention, a pulse width of the emission control signals ES1 to ESn may be equal to or larger than a pulse width of the scan signals SS1 to SSn.

The data driver 120 may receive the data driving control signals DCS from the timing controller 150. The data driver 120 may generate data signals DS1 to DSm based on the received data driving control signals DCS and the data DATA. The generated data signals DS1 to DSm may be supplied to the data lines D1 to Dm in synchronization with the scan signals SS1 to SSn supplied to the scan lines S1 to Sn. For example, when the $1^{st}$ scan signal SS1 is supplied, the generated data signals DS1 to DSm corresponding to the pixels 140(1)(1 to m) may be synchronously supplied to the $1^{st}$ to the m-th pixels in the $1^{st}$ row via the data lines D1 to Dm, and when the nth scan signal SSn is supplied, the generated data signals DS1 to DSm corresponding to the pixels 140(*n*)(1 to m) may be synchronously supplied to the $1^{st}$ to the m-th pixels in the n-th row via the data lines D1 to Dm.

The data driver 120 may supply predetermined currents to the data lines D1 to Dm during a first period of one horizontal period 1H for driving one or more of the pixels 140. For example, one horizontal period 1H may correspond to a complete period associated with one of the scan signals SS1 to SSn and a corresponding one of the data signals DS1 to DSm being supplied to the respective pixel 140 in order to drive the respective pixel 140. The data driver 120 may supply predetermined voltages to the data lines D1 to Dm during a second period of the one horizontal period. For example, one horizontal period 1H may correspond to a complete period associated with one of the scan signals SS1 to SSn and a corresponding one of the data signals DS1 to DSm being supplied to the respective pixel 140 in order to drive the respective pixel 140. d 1H. In embodiments of the invention, the data driver 120 may include at least one data driving circuit 200 for supplying such predetermined currents and predetermined voltages during the first and second periods of one horizontal period 1H. In the following description, the predetermined voltages that may be supplied to the data lines D1 to Dm during the second period will be referred to as the data signals DS1 to DSm.

The pixel unit 130 may be connected to a first power source ELVDD for supplying a first voltage VDD, a second power source ELVSS for supplying a second voltage VSS and a reference power source ELVref for supplying a reference voltage Vref to the pixels 140. The first power source ELVDD, the second power source ELVSS and the reference power source ELVref may be externally provided. The pixels 140 may receive the first voltage VDD signal and the second voltage VSS signal, and may control the currents that flow through respective light emitting devices/materials, e.g., OLEDs, in accordance with the data signals DS1 to DSm that may be supplied by the data driver 120 to the pixels 140. The pixels 140 may thereby generate light components corresponding to the received data DATA.

Some or all of the pixels 140 may receive the first voltage VDD signal, the second voltage VSS signal and the reference voltage Vref signal from the respective first, second and reference power sources ELVDD, ELVSS and ELVref. The pixels 140 may compensate for a voltage drop in the first voltage VDD signal and/or threshold voltage(s) using the reference voltage Vref signal. The amount of compensation may be based on a difference between voltage values of the reference voltage Vref signal and the first voltage VDD signal respectively supplied by the reference power source ELVref and the first power source ELVDD. The pixels 140 may supply respective currents from the first power source ELVDD to the second power source ELVSS via, for example, the OLEDs in response to the respective data signals DS1 to DSm. In embodiments of the invention, each of the pixels 140 may have, for example, the structure illustrated in FIG. 3 or 5.

Figure 3:
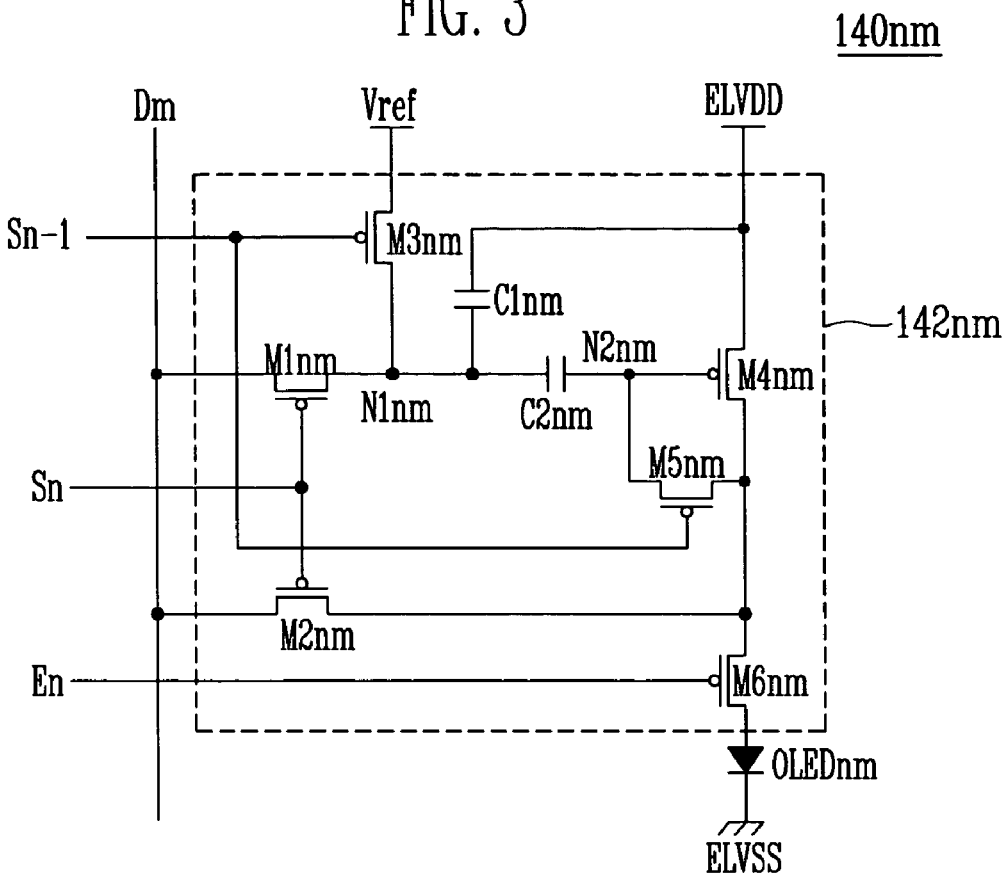
FIG. 3 illustrates a circuit diagram of an exemplary pixel employable in the light emitting display illustrated in FIG. 2.

FIG. 3 illustrates a circuit diagram of an nm-th exemplary pixel 140*nm* employable in the light emitting display illustrated in FIG. 2. For simplicity, FIG. 3 illustrates the nm-th pixel that may be the pixel provided at the intersection of the n-th row of scan lines Sn and the m-th row of data lines Dm. The nm-th pixel 140*nm* may be connected to the m-th data line Dm, the n−1th and nth scan lines Sn−1 and Sn and the nth emission control line En. For simplicity, FIG. 3 only illustrates one exemplary pixel 140*nm*. In embodiments of the invention, the structure of the exemplary pixel 140*nm* may be employed for all or some of the pixels 140 of the light emitting display.

Referring to FIG. 3, the nm-th pixel 140*nm* may include a light emitting material/device, e.g., OLEDnm, and an nm-th pixel circuit 142*nm* for supplying current to the associated light emitting material/device.

The nm-th OLEDnm may generate light of a predetermined color in response to the current supplied from the nm-th pixel circuit 142*nm*. The nm-th OLEDnm may be formed of organic material, phosphor and/or inorganic material.

In embodiments of the invention, the nm-th pixel circuit 142*nm* may generate a compensation voltage for compensating for variations within and/or among the pixels 140 such that the pixels 140 may display images with uniform brightness. The nm-th pixel circuit 142*nm* may generate the compensation voltage using a previously supplied scan signal of the scan signals SS1 to SSn during each scan cycle. In embodiments of the invention, one scan cycle may correspond to scan signals SS1 to SSn being sequentially supplied. Thus, in embodiments of the invention, during each cycle, the n−1th scan signal SSn−1 may be supplied prior to the nth scan signal SSn and when the n−1th scan signal SSn−1 is being supplied to the n−1th scan line of the light emitting display, the nm-th pixel circuit 142*nm* may employ the n−1th scan signal SSn−1 to generate a compensation voltage. For example, the second pixel in the second column, i.e., the 2-2 pixel $\mathbf{140}_{22}$, may generate a compensation voltage using the first scan signal SS1.

The compensation voltage may compensate for a voltage drop in a source voltage signal and/or a voltage drop resulting from a threshold voltage of the transistor of the nm-th pixel circuit 142*nm*. For example, the nm-th pixel circuit 142*nm* may compensate for a voltage drop of the first voltage VDD signal and/or a threshold voltage of a transistor, e.g., a threshold voltage of the fourth transistor M4*nm* of the pixel circuit 142*nm* based on the compensation voltage that may be generated using a previously supplied scan line during the same scan cycle.

In embodiments of the invention, the pixel circuit 142*nm* may compensate for a drop in the voltage of the first power source ELVDD and the threshold voltage of a fourth transistor M4*nm* when the n−1th scan signal SSn−1 is supplied to the n−1th scan line Sn−1, and may charge the voltage corresponding to the data signal when the nth scan signal SSn is supplied to the nth scan line Sn. In embodiments of the invention, the pixel circuit 142*nm* may include first to sixth transistors M1*nm* to M6*nm*, a first capacitor C1*nm* and a second capacitor C2*nm* to help generate the compensation voltage and to drive the light emitting material/device.

A first electrode of the first transistor M1*nm* may be connected to the data line Dm and a second electrode of the first transistor M1*nm* may be connected to a first node N1*nm*. A gate electrode of the first transistor M1*nm* may be connected to the nth scan line Sn. The first transistor M1*nm* may be turned on when the nth scan signal SSn is supplied to the nth scan line Sn. When the first transistor M1*nm* is turned on, the data line Dm may be electrically connected to the first node N1*nm*.

A first electrode of the first capacitor C1*nm* may be connected to the first node N1*nm* and a second electrode of the first capacitor C1*nm* may be connected to the first power source ELVDD.

A first electrode of the second transistor M2*nm* may be connected to the data line Dm and a second electrode of the second transistor M2*nm* may be connected to a second electrode of the fourth transistor M4*nm*. A gate electrode of a second transistor M2*nm* may be connected to the nth scan line Sn. The second transistor M2*nm* may be turned on when the nth scan signal SSn is supplied to the nth scan line Sn. When the second transistor M2*nm* is turned on, the data line Dm may be electrically connected to the second electrode of the fourth transistor M4*nm*.

A first electrode of the third transistor M3*nm* may be connected to the reference power source ELVref and a second electrode of the third transistor M3*nm* may be connected to the first node N1*nm*. A gate electrode of the third transistor M3*nm* may be connected to the n-th scan line Sn−1. The third transistor M3*nm* may be turned on when the n−1th scan signal SSn−1 is supplied to the n−1th scan line Sn−1. When the third transistor M3*nm* is turned on, the reference voltage Vref may be electrically connected to the first node N1*nm*.

A first electrode of the fourth transistor M4*nm* may be connected to the first power source ELVDD and the second electrode of the fourth transistor M4*nm* may be connected to a first electrode of the sixth transistor M6*nm*. A gate electrode of the fourth transistor M4*nm* may be connected to the second node N2*nm*.

A first electrode of the second capacitor C2*nm* may be connected to the first node N1*nm* and a second electrode of the second capacitor C2*nm* may be connected to the second node N2*nm*.

In embodiments of the invention, the first and second capacitors C1*nm* and C2*nm* may be charged when the n−1th scan signal SSn−1 is supplied. In particular, the first and second capacitors C1*nm* and C2*nm* may be charged and the fourth transistor M4*nm* may supply a current corresponding to a voltage at the second node N2*nm* to the first electrode of the sixth transistor M6*nm*.

A second electrode of the fifth transistor M5*nm* may be connected to the second node N2*nm* and a first electrode of the fifth transistor M5*nm* may be connected to the second electrode of the fourth transistor M4*nm*. A gate electrode of the fifth transistor M5*nm* may be connected to the n−1th scan line Sn−1. The fifth transistor M5*nm* may be turned on when the n−1th scan signal SSn−1 is supplied to the n−1th scan line Sn−1 so that current flows through the fourth transistor M4*nm*. Therefore, the fourth transistor M4*nm* may operate as a diode.

The first electrode of the sixth transistor M6*nm* may be connected to the second electrode of the fourth transistor M4*nm* and a second electrode of the sixth transistor M6*nm* may be connected to an anode electrode of the nm-th OLEDnm. A gate electrode of the sixth transistor M6*nm* may be connected to the nth emission control line En. The sixth transistor M6*nm* may be turned off when an emission control signal ESn is supplied, e.g., a high voltage signal, to the nth emission control line En and may be turned on when no emission control signal, e.g., a low voltage signal, is supplied to the nth emission control line En.

In embodiments of the invention, the emission control signal ESn supplied to the nth emission control line En may be supplied to at least partially overlap both the n−1th scan signal SSn−1 that may be supplied to the n−1th scan line Sn−1 and the nth scan signal SSn that may be supplied to nth scan line Sn. Therefore, the sixth transistor M6*nm* may be turned off when the n−1th scan signal SSn−1 is supplied, e.g., a low voltage signal is supplied, to the n−1th scan line Sn−1 and the n-th scan signal SSn is supplied, e.g., a low voltage signal is supplied, to the nth scan line Sn so that a predetermined voltage may be charged in the first and second capacitors C1*nm* and C2*nm*. The sixth transistor M6*nm* may be turned on during other times to electrically connect the fourth transistor M4*nm* and the nm-th OLEDnm to each other. In the exemplary embodiment shown in FIG. 3, the transistors M1*nm* to M6*nm* are PMOS transistors, which may turn on when a low voltage signal is supplied to the respective gate electrode and may turn on when a high voltage signal is supplied to the respective gate electrode. However, the present invention is not limited to PMOS devices.

In the pixel illustrated in FIG. 3, the reference voltage Vref signal is not supplied to the respective OLEDs. Because the reference power source ELVref does not supply current to the pixels 140, a drop in the voltage of the reference voltage Vref may not occur. Therefore, it is possible to maintain the voltage value of the reference voltage Vref signal uniform regardless of the positions of the pixels 140. In embodiments of the invention, the voltage value of the reference voltage Vref may be equal to or different from the first voltage ELVDD.

Figure 4:
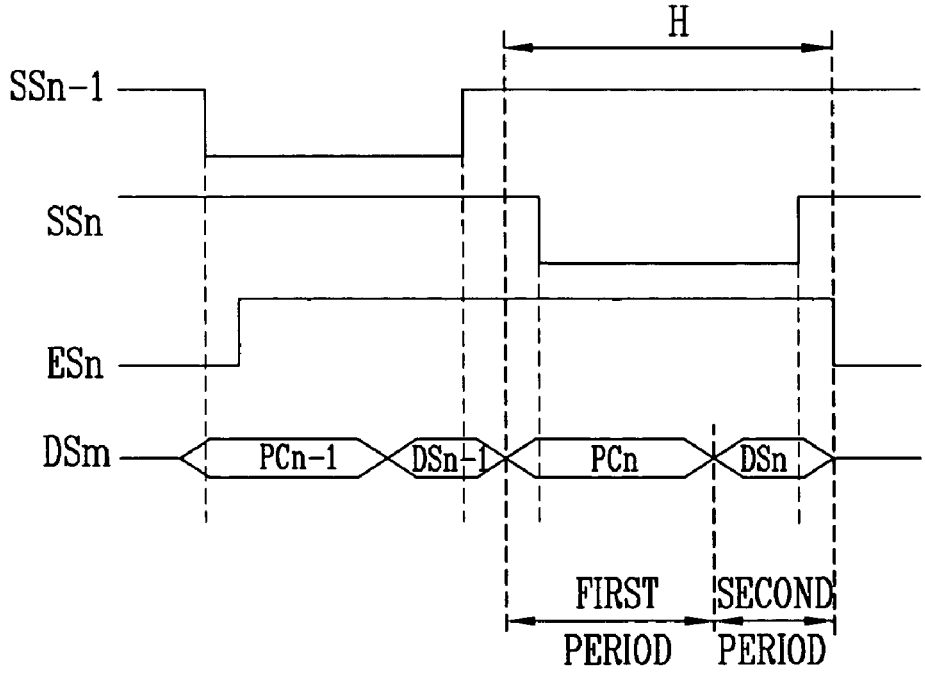
FIG. 4 illustrates exemplary waveforms employable for driving the pixel illustrated in FIG. 3.

FIG. 4 illustrates exemplary waveforms that may be employed for driving the exemplary nm-th pixel 140*nm* illustrated in FIG. 3. As shown in FIG. 4, each horizontal period 1H for driving the nm-th pixel 140*nm* may be divided into a first period and a second period. During the first period, predetermined currents (PC) may respectively flow through the data lines D1 to Dm. During the second period, the data signals DS1 to DSm may be supplied to the respective pixels 140 via the data lines D1 to Dm. During the first period, the respective PCs may be supplied from each of the pixel(s) 140 to a data driving circuit 200 that may be capable of functioning, at least in part, as a current sink. During the second period, the data signals DS1 to DSm may be supplied from the data driving circuit 200 to the pixel(s) 140. For simplicity, in the following description, it will be assumed that, at least initially, i.e., prior to any voltage drop that may result during operation of the pixels 140, the voltage value of the reference voltage Vref signal is equal to the voltage value of the first voltage VDD signal.

Exemplary methods of operating the nm-th pixel circuit 142*nm* of the nm-th pixel 140*nm* of the pixels 140 will be described in detail with reference to FIGS. 3 and 4. First, the n−1th scan signal SSn−1 may be supplied to the n−1th scan line Sn−1 to control the on/off operation of the m pixels that may be connected to the n−1th scan line Sn−1. When the scan signal SSn−1 is supplied to the n−1th scan line Sn−1, the third and fifth transistors M3*nm* and M5*nm* of the nm-th pixel circuit 142*nm* of the nm pixel 140*nm* may be turned on. When the fifth transistor M5*nm* is turned on, current may flow through the fourth transistor M4*nm* so that the fourth transistor M4*nm* may operate as a diode. When the fourth transistor M4*nm* operates as a diode, the voltage value of the second node N2*nm* may correspond to a difference between the threshold voltage of the fourth transistor M4*nm* and the voltage of the first voltage VDD signal being supplied by the first power source ELVDD.

More particularly, when the third transistor M3*nm* is turned on, the reference voltage Vref signal from the reference power source ELVref may be applied to the first node N1*nm*. The second capacitor C2*nm* may be charged with a voltage corresponding to the difference between the first node N1*nm* and the second node N2*nm*. In embodiments of the invention in which the reference voltage Vref signal from the reference power source ELVref and the first voltage VDD from the first power source ELVDD may, at least initially, i.e., prior to any voltage drop that may result during operation of the pixels 140, be equal, the voltage corresponding to the threshold voltage of the fourth transistor M4*nm* may be charged in the second capacitor C2*nm*. In embodiments of the invention in which a predetermined drop in voltage of the first voltage VDD signal occurs, the threshold voltage of the fourth transistor M4*nm* and a voltage corresponding to the magnitude of the voltage drop of the first power source ELVDD may be charged in the second capacitor C2*nm*.

In embodiments of the invention, during the period where the n−1th scan signal SSn−1 may be supplied to the n−1th scan line Sn−1, a predetermined voltage corresponding to the sum of the voltage corresponding to the voltage drop of the first voltage VDD signal and the threshold voltage of the fourth transistor M4*nm* may be charged in the second capacitor C2*nm*. By storing the voltage corresponding to a sum of the voltage drop of the first voltage VDD signal from the first power source ELVDD and the threshold voltage of the fourth transistor M4*nm* during operation of the respective n−1 pixel of in the m-th column, it is possible to later utilize the stored voltage to compensate for both the voltage drop of the first voltage VDD signal and the threshold voltage during operation of the respective nm-th pixel 140*nm*.

In embodiments of the invention, the voltage corresponding to the sum of the threshold voltage of the fourth transistor M4*nm* and the difference between the reference voltage signal Vref and the first voltage VDD signal may be charged in the second capacitor C2*nm* before the nth scan signal SSn is supplied to the nth scan line Sn. When the nth scan signal SSn is supplied to the nth scan line Sn, the first and second transistors M1*nm* and M2*nm* may be turned on. During the first period of one horizontal period, when the second transistor M2*nm* of the pixel circuit 142*nm* of the nm-th pixel 140*nm* is turned on, the PC may be supplied from the nm-th pixel 140*nm* to the data driving circuit 200 via the data line Dm. In embodiments of the invention, the PC may be supplied to the data driving circuit 200 via the first power source ELVDD, the fourth transistor M4*nm*, the second transistor M2*nm* and the data line Dm. A predetermined voltage may then be charged in the first and second capacitors C1*nm* and C2*nm* in response to the supplied PC.

The data driving circuit 200 may reset a voltage of a gamma voltage unit (not shown) based on a predetermined voltage value, i.e., compensation voltage that may be generated when the PC sinks, as described above. The reset voltage from the gamma voltage unit (not shown) may be used to generate the data signals DS1 to DSm to be respectively supplied to the data lines D1 to Dm.

In embodiments of the invention, the generated data signals DS1 to DSm may be respectively supplied to the respective data lines D1 to Dm during the second period of the one horizontal period. More particularly, e.g., the respective generated data signal DSm may be supplied to the respective first node N1*nm* via the first transistor M1*nm* during the second period of the one horizontal period. Then, the voltage corresponding to difference between the data signal DSm and the first power source ELVDD may be charged in the first capacitor C1*nm*. The second node N2*nm* may then float and the second capacitor C2*nm* may maintain the previously charged voltage.

In embodiments of the invention, during the period when the n−1 pixel in the m-th column is being controlled and the scan signal SSn−1 is being supplied to the previous scan line Sn−1, a voltage corresponding to the threshold voltage of the fourth transistor M4*nm* and the voltage drop of the first voltage VDD signal from the first power source ELVDD may be charged in the second capacitor C2*nm* of the nm-th pixel 140*nm* to compensate for the voltage drop of the first voltage VDD signal from the first power source ELVDD and the threshold voltage of the fourth transistor M4*nm*.

In embodiments of the invention, during the period when the n-th scan signal Sn is supplied to the n-th scan line Sn, the voltage of the gamma voltage unit (not shown) may be reset so that the electron mobility of the transistors included in the respective n-th pixels 140*n* associated with each data line D1 to Dm may be compensated for and the respective generated data signals DS1 to DSm may be supplied to the n-th pixels 140*n* using the respective reset gamma voltages. Therefore, in embodiments of the invention, non-uniformity in the threshold voltages of the transistors and the electron mobility may be compensated, and images with uniform brightness may be displayed. Processes for resetting the voltage of the gamma voltage unit will be described below.

Figure 5:
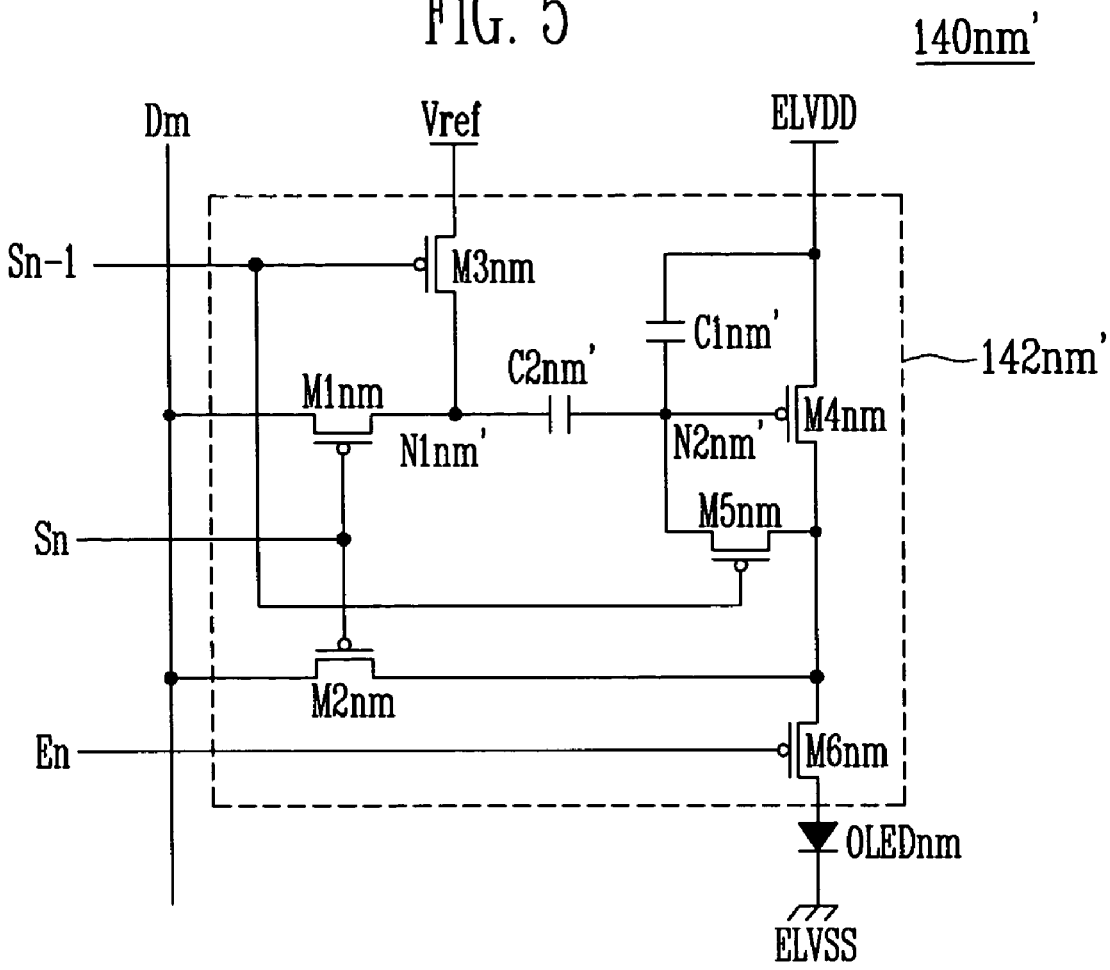
FIG. 5 illustrates a circuit diagram of another exemplary pixel employable in the light emitting display illustrated in FIG. 2.

FIG. 5 illustrates another exemplary embodiment of an nm-th pixel 140*nm*' employable by the light emitting display illustrated in FIG. 2. The structure of the nm-th pixel 140*nm*' illustrated in FIG. 5 is substantially the same as the structure of the nm-th pixel 140*nm* illustrated in FIG. 3, but for the arrangement of a first capacitor C1*nm*' in a pixel circuit 142*nm*' and respective connections to a first node N1*nm*' and a second node N2*nm*'. In the exemplary embodiment illustrated in FIG. 5, a first electrode of the first capacitor C1*nm*' may be connected to the first node N1*nm*' and a second electrode of the first capacitor C1*nm*' may be connected to the first power source ELVDD. A first electrode of the second capacitor C2*nm* may be connected to the first node N1*nm*' and a second electrode of the second capacitor C2*nm* may be connected to the second node N2*nm*'. The first node N1*nm*' may be connected to the second electrode of the first transistor M1*nm*, the second electrode of the third transistor M3*nm* and the first electrode of the second capacitor C2*nm*. The second node N2*nm*' may be connected to the gate electrode of the fourth transistor M4*nm*, the second electrode of the fifth transistor M5*nm*, the first electrode of the first capacitor C1*nm*' and the second electrode of the second capacitor C2*nm*.

In the following description, the same reference numerals employed above in the description of the nm-th pixel 140*nm* shown in FIG. 3 will be employed to describe like features in the exemplary embodiment of the nm-th pixel 140*nm*' illustrated in FIG. 5.

Exemplary methods for operating the nm-th pixel circuit 142*nm*' of the nm-th pixel 140*nm*' of the pixels 140 will be described in detail with reference to FIGS. 4 and 5. First, during a horizontal period for driving the n−1 pixels 140(*n*−1)(1 to m), i.e., the pixels arranged in the (n−1)th row, when the n−1th scan signal SSn−1 is supplied to the n−1th scan line Sn−1, the third and fifth transistors M3*nm* and M5*nm* of the n-th pixel(s) 140(*n*)(1 to m), i.e., the pixels arranged in the n-th row, may be turned on.

When the fifth transistor M5*nm* is turned on, current may flow through the fourth transistor M4*nm* so that the fourth transistor M4*nm* may operate as a diode. When the fourth transistor M4*nm* operates as a diode, a voltage corresponding to a value obtained by subtracting the threshold voltage of the fourth transistor M4*nm* from the first power source ELVDD may be applied to a second node N2*nm*'. The voltage corresponding to the threshold voltage of the fourth transistor M4*nm* may be charged in the first capacitor C1*nm*'. As shown in FIG. 5, the first capacitor C1*nm*' may be provided between the second node N2*nm*' and the first power source ELVDD.

When the third transistor M3*nm* is turned on, the voltage of the reference power source ELVref may be applied to the first node N1*nm*'. Then, the second capacitor C2*nm* may be charged with the voltage corresponding to difference between a first node N1*nm*' and the second node N2*nm*'. During the period where the n−1th scan signal SSn−1 is supplied to the n−1th scan line Sn−1 and the first and second transistors M1*nm* and M2*nm* may be turned off, the data signal DSm may not be supplied to the nm-th pixel 140*nm'*.

Then, during the first period of the one horizontal period for driving the nm-th pixel 140*nm*', the scan signal SSn may be supplied to the nth scan line Sn and the first and second transistors M1*nm* and M2*nm* may be turned on. When the second transistor M2*nm* is turned on, during the first period of the one horizontal period, the respective PC may be supplied from the nm-th pixel 140*nm*' to the data driving circuit 200 via the data line Dm. The PC may be supplied to the data driving circuit 200 via the first power source ELVDD, the fourth transistor M4*nm*, the second transistor M2*nm* and the data line Dm. In response to the PC, predetermined voltage may be charged in the first and second capacitors C1*nm*' and C2*nm*.

The data driving circuit 200 may reset the voltage of the gamma voltage unit using the compensation voltage applied in response to the PC to generate the data signal DS using the respectively reset voltage of the gamma voltage unit.

Then, during the second period of the one horizontal period for driving the nm-th pixel 140*nm*', the data signal DSm may be supplied to the first node N1*nm*'. The predetermined voltage corresponding to the data signal DSm may be charged in the first and second capacitors C1*nm*' and C2*nm*.

When the data signal DSm is supplied, the voltage of the first node N1*nm*' may fall from the voltage Vref of the reference power source ELVref to the voltage of the data signal DSm. At this time, as the second node N2*nm*' may be floating, the voltage value of the second node N2*nm*' may be reduced in response to the amount of voltage drop of the first node N1*nm*'. The amount of reduction in voltage that may occur at the second node N2*nm*' may be determined by the capacitances of the first and second capacitors C1*nm*' and C2*nm*.

When the voltage of the second node N2*nm*' falls, the predetermined voltage corresponding to the voltage value of the second node N2*nm*' may be charged in the first capacitor C1*nm*'. When the voltage value of the reference power source ELVref is fixed, the amount of voltage charged in the first capacitor C1*nm*' may be determined by the data signal DSm. That is, in the nm-th pixel 140*nm*' illustrated in FIG. 5, because the voltage values charged in the capacitors C1*nm*' and C2*nm* may be determined by the reference power source ELVref and the data signal DSm, it may be possible to charge a desired voltage irrespective of the voltage drop of the first power source ELVDD.

In embodiments of the invention, the voltage of the gamma voltage unit may be reset so that the electron mobility of the transistors included in each of the pixels 140 may be compensated for and the respective generated data signal may be supplied using the reset gamma voltage. In embodiments of the invention, non-uniformity among the threshold voltages of the transistors and deviation in the electron mobility of the transistors may be compensated for, thereby enabling images with uniform brightness to be displayed.

Figure 6:
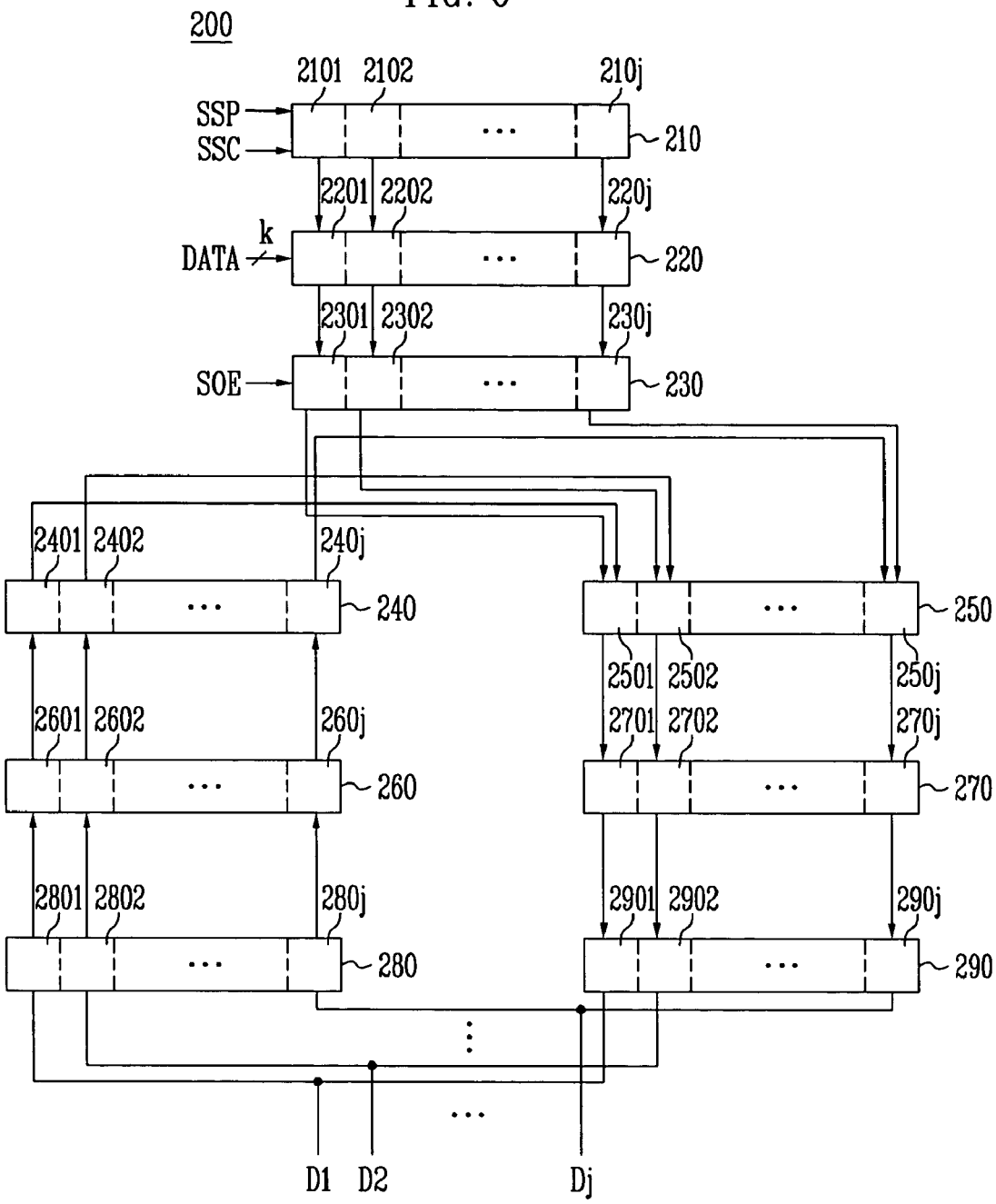
FIG. 6 illustrates a block diagram of a first embodiment of the data driving circuit illustrated in FIG. 2.

FIG. 6 illustrates a block diagram of a first exemplary embodiment of the data driving circuit illustrated in FIG. 2. For simplicity, in FIG. 6, it is assumed that the data driving circuit 200 has j channels, where j is a natural number equal to or greater than 2.

As shown in FIG. 6, the data driving circuit 200 may include a shift register unit 210, a sampling latch unit 220, a holding latch unit 230, a gamma voltage unit 240, a digital-analog converter unit (hereinafter, referred to as a DAC) 250, a first buffer unit 270, a second buffer unit 260, a current supply unit 280 and a selector 290.

The shift register unit 210 may receive a source shift clock SSC and a source start pulse SSP from the timing controller 150. The shift register unit 210 may utilize the source shift clock SSC and the source start pulse SSP to sequentially generate j sampling signals while shifting the source start pulse SSP every one period of the source shift clock SSC. The shift register unit 210 may include j shift registers 2101 to 210*j*.

The sampling latch unit 220 may sequentially store the respective data DATA in response to sampling signals sequentially supplied from the shift register unit 210. The sampling latch unit 220 may include j sampling latches 2201 to 220*j* in order to store the j data DATA. Each of the sampling latches 2201 to 220*j* may have the magnitude corresponding to the number of bits of the data DATA. For example, when the data DATA is composed of k bits, each of the sampling latches 2201 to 220*j* may have the magnitude of k bits.

The holding latch unit 230 may receive the data DATA from the sampling latch unit 220 to store the data DATA when a source output enable SOE signal is input. The holding latch unit 230 may supply the data DATA stored therein when the SOE signal is input to the DAC unit 250. The holding latch unit 230 may include j holding latches 2301 to 230*j* in order to store the j data DATA. Each of the holding latches 2301 to 230*j* may have a magnitude corresponding to the number of bits of the data DATA. For example, each of the holding latches 2301 to 230*j* may have the magnitude of k bits so that the respective data DATA may be stored.

Figure 8:
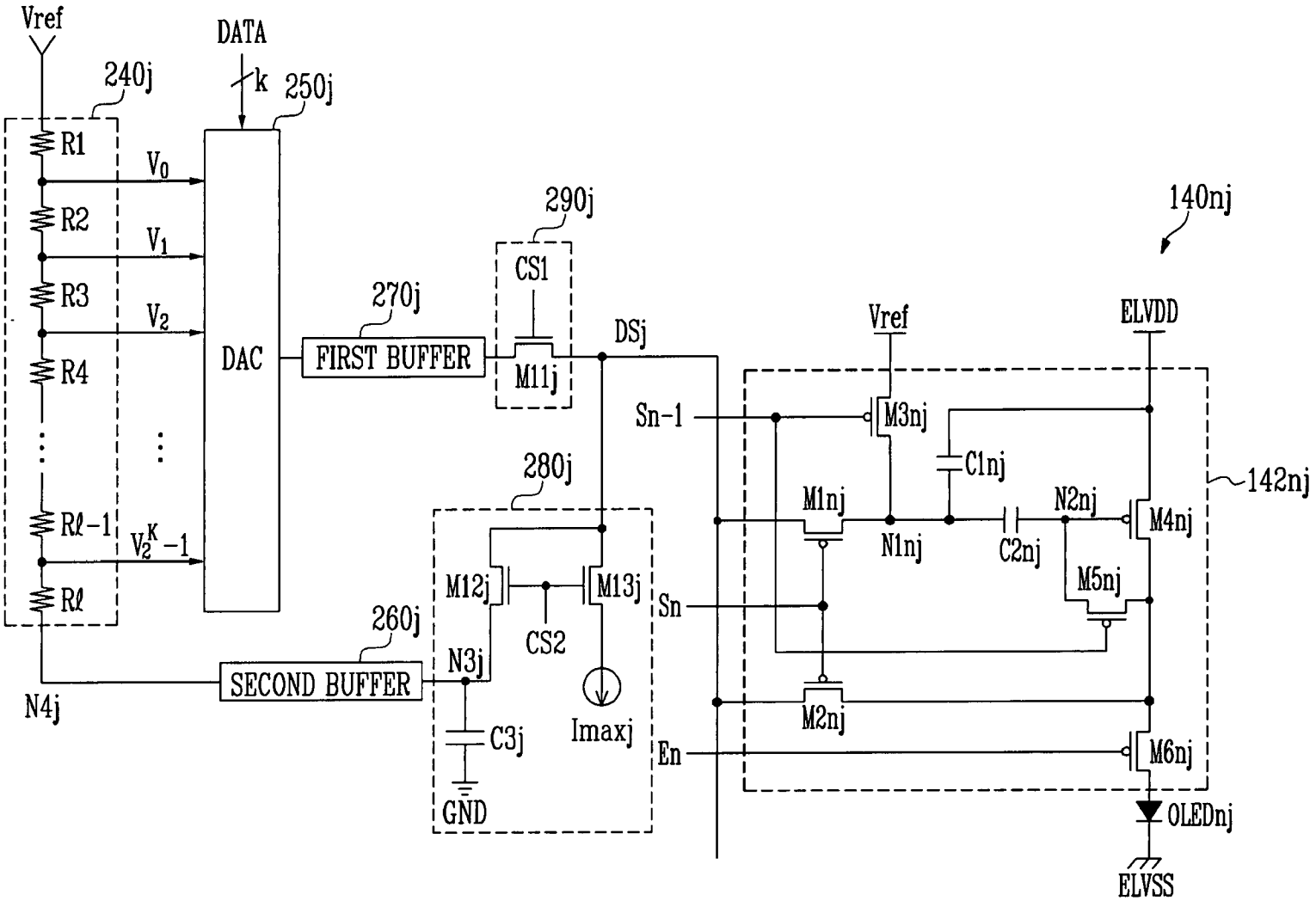
FIG. 8 illustrates a schematic diagram of a first embodiment of a connection scheme connecting a voltage generator, a digital-analog converter, a first buffer, a second buffer, a switching unit and a current sink unit illustrated in FIG. 6, and the pixel illustrated in FIG. 3.

The gamma voltage unit 240 may include j voltage generators 2401 to 240*j* for generating a predetermined gray scale voltage in response to the data DATA of k bits. As illustrated in FIG. 8, each of the voltage generators 2401 to 240*j* may include a plurality of voltage dividing resistors R1 to Rl for generating $2^k$ gray scale voltages. The voltage generators 2401 to 240*j* may reset values of the gray scale voltages using the compensation voltage supplied from the second buffer 260 and may supply the reset gray scale voltages to the DACs 2501 to 250*j*.

The DAC unit 250 may include j DACs 2501 to 250*j* that may generate the data signals DS in response to the bit values of the data DATA. Each of the DACs 2501 to 250*j* may select one of the plurality of gray scale voltages in response to the bit values of the data DATA supplied from the holding latch unit 230 to generate respective data signals DS1 to DSj.

The first buffer unit 270 may supply the data signals DS supplied from the DAC unit 250 to the selector 290. The first buffer unit 270 may include j first buffers 2701 to 270*j*.

The selector 290 may control electrical connections between the data lines D1 to Dj and the first buffers 2701 to 270*j*. The selector 290 may electrically connect the data lines D1 to Dj and the first buffers 2701 to 270*j* to each other during the second period of the one horizontal period. In embodiments of the invention, the selector 290 may electrically connect the data lines D1 to Dj and the first buffers 2701 to 270*j* to each other only during the second period. During periods other than the second period, the selector 290 may keep the data lines D1 to Dj and the first buffers 2701 to 270*j* electrically disconnected from each other.

Figure 10:
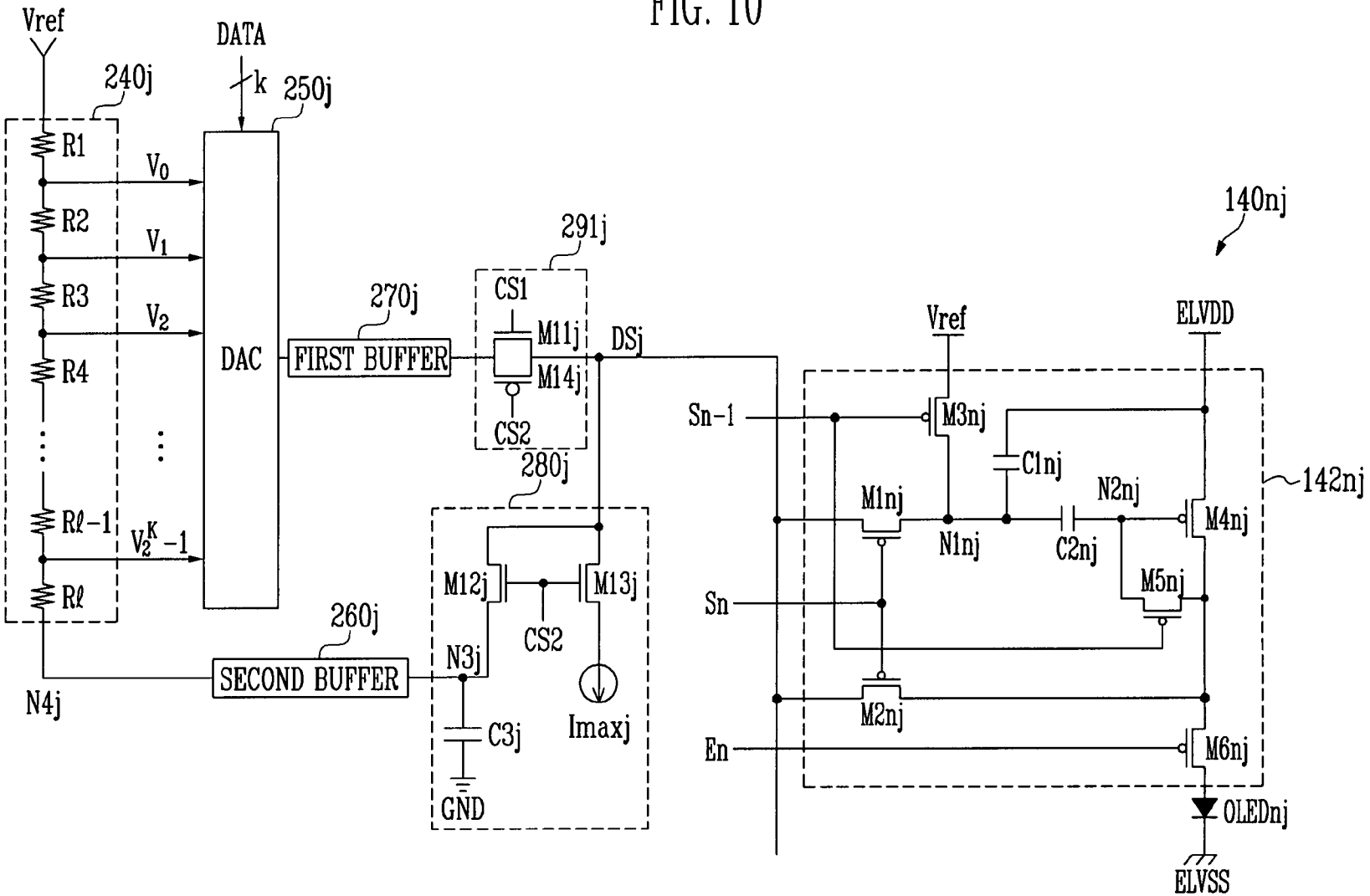
FIG. 10 illustrates the connection scheme illustrated in FIG. 8 employing another embodiment of a switching unit.

The selector 290 may include j switching units 2901 to 290*j*. The generated respective data signals DS1 to DSj may be respectively supplied from the first buffers 2701 to 270*j* to the data lines D1 to Dj via the switching units 2901 to 290*j*. In embodiments of the invention, the selector 290 may employ other types of switching units. FIG. 10 illustrates another exemplary embodiment of a switching unit switching unit 291*j* that may be employed by the selector 290.

The current supply unit 280 may sink the PC from the pixels 140 connected to the data lines D1 to Dj during the first period of the one horizontal period. For example, the current supply unit 280 may sink the current from each of the pixels 140. As discussed below, the amount of current that each pixel may sink to the current supply unit 280 may correspond to or may be greater than a minimum amount of current to be supplied to the respective OLED for the respective one of the pixels 140 to emit light with the maximum brightness. The current supply unit 280 may help enable predetermined compensation voltages to be respectively generated when the respective currents sink to the second buffer unit 260. The current supply unit 280 may include j current sink units 2801 to 280*j*.

The second buffer unit 260 may supply the compensation voltage supplied from the current supply unit 280 to the gamma voltage unit 240. Therefore, the second buffer unit 260 may include j second buffers 2601 to 260*j*.

Figure 7:
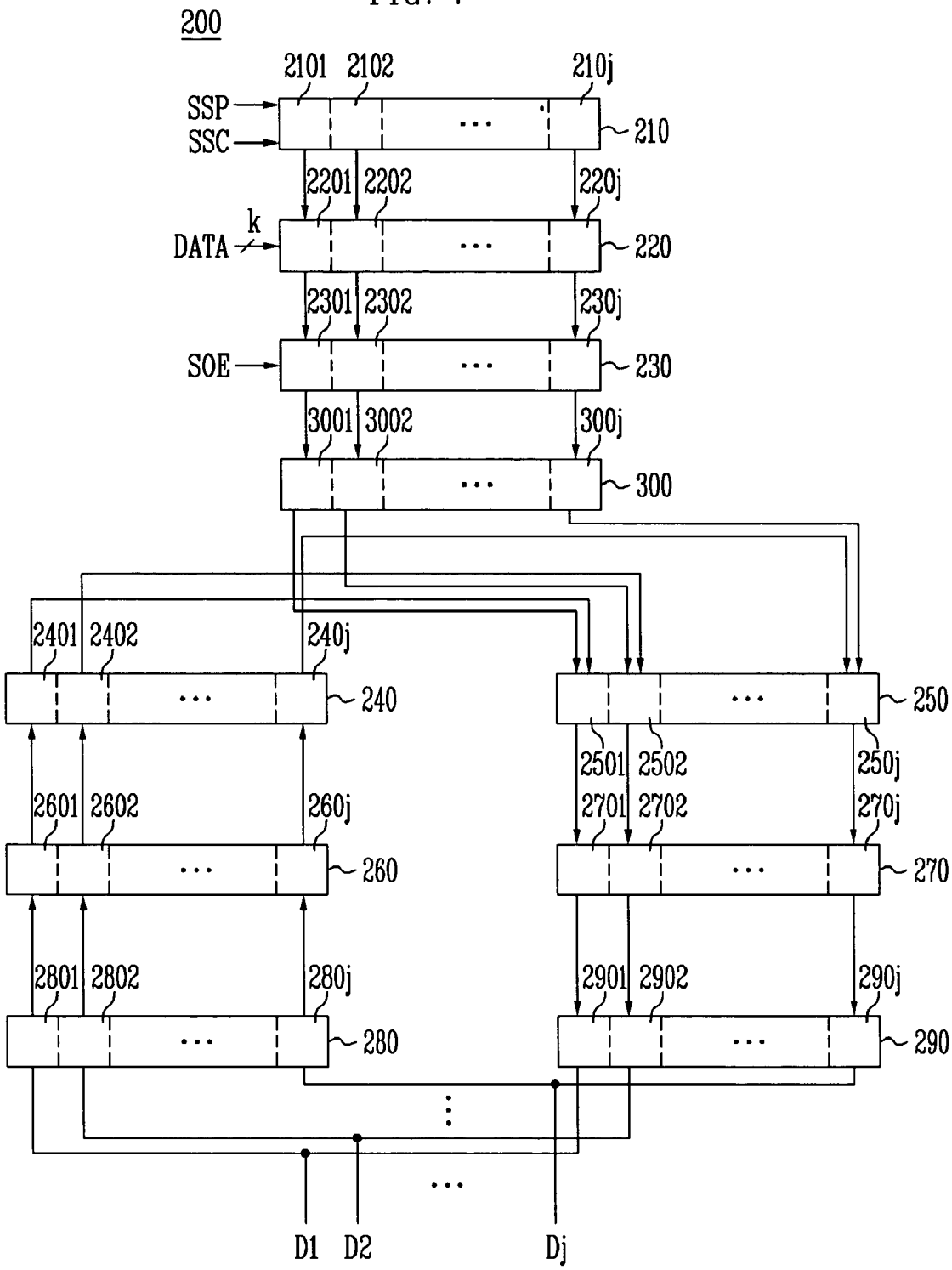
FIG. 7 illustrates a block diagram of a second embodiment of the data driving circuit illustrated in FIG. 2.

In embodiments of the invention, as illustrated in FIG. 7, the data driving circuit 200 may further include a level shifter unit 300. The level shifter unit 300 may be connected to the holding latch unit 230 and the DAC unit 250. The level shifter unit 300 may increase or decrease voltage levels of the data DATA supplied from the holding latch unit 230 before supplying the data DATA to the DAC unit 250. When the data DATA being supplied from an external system to the data driving circuit 200 has high voltage levels, circuit components with high voltage resistant properties should generally be provided in response to the voltage levels, thereby increasing the manufacturing cost. In embodiments of the invention, the data DATA being supplied from an external system to the data driving circuit 200 may have low voltage levels and the low voltage level may be transitioned to a high voltage level by the level shifter unit 300.

FIG. 8 illustrates a first embodiment of a connection scheme for connecting the voltage generator 240*j*, the DAC 250*j*, the first buffer 270*j*, the second buffer 260*j*, the switching unit 290*j*, the current sink unit 280*j* and a pixel 140*nj* in a specific channel. For simplicity, FIG. 8 only illustrates one channel, i.e., the jth channel and it is assumed that the data line Dj is connected to an nj-th pixel 140*nj* according to the exemplary embodiment of the nm-th pixel 140*nm* illustrated in FIG. 3.

As shown in FIG. 8, the voltage generator 240*j* may include a plurality of voltage dividing resistors R1 to Rl. The voltage dividing resistors R1 to Rl may be positioned between the reference power source ELVref and the second buffer 260*j* and may divide voltages supplied thereto. The voltage dividing resistors R1 to Rl may divide the voltage between the voltage of the reference power source ELVref and the compensation voltage supplied from the second buffer 260*j* and may generate a plurality of gray scale voltages V0 to $2^k-1$. The generated plurality of gray scale voltages V0 to $2^k-1$ may be supplied to the generated gray scale voltages V0 to $2^k-1$ to the DAC 250*j*.

The DAC 250*j* may select one gray scale voltage among the gray scale voltages V0 to $2^k-1$ in response to the bit values of the data DATA and may supply the selected gray scale voltage to the first buffer 270*j*. The gray scale voltage selected by the DAC 250*j* may be used as the respective data signal DSj. The first buffer 270*j* may transmit the data signal DSj supplied from the DAC 250*j* to the switching unit 290*j*.

Figure 9:
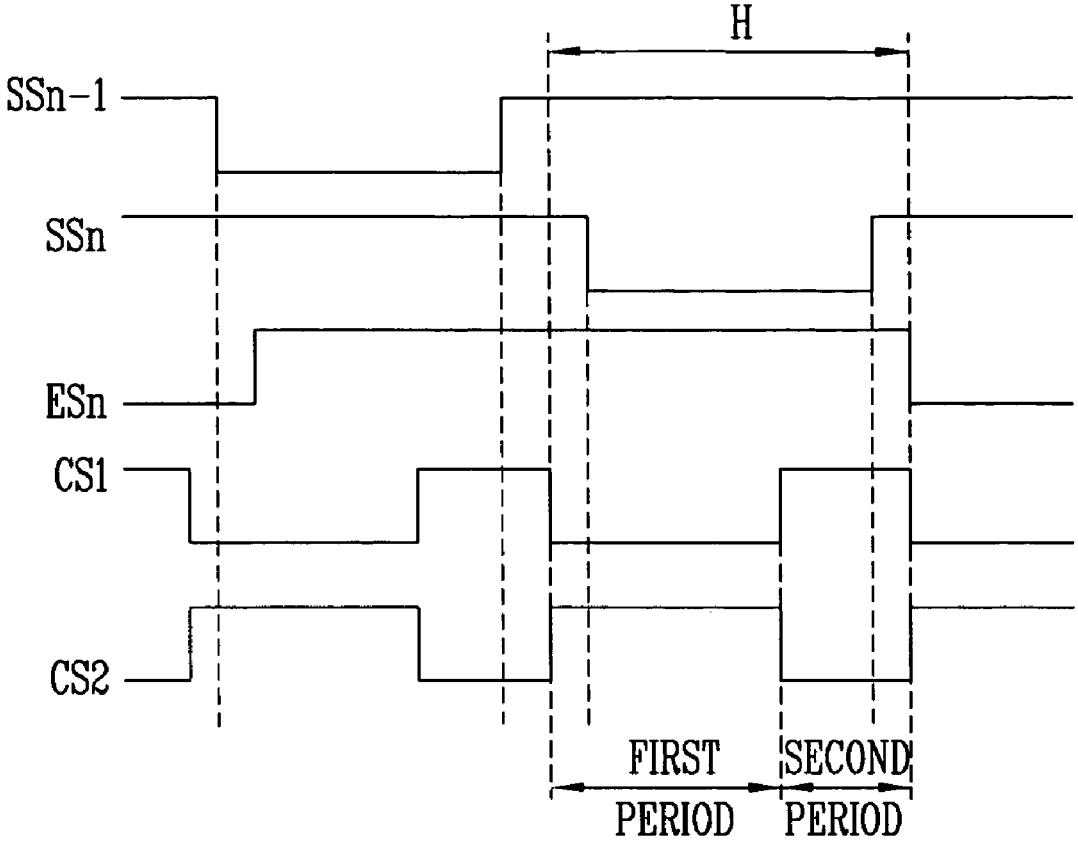
FIG. 9 illustrates exemplary waveforms employable for driving the pixel, the switching unit and the current sink unit illustrated in FIG. 8.

The switching unit 290*j* may include an $11^{th}$ transistor M11*j*. The $11^{th}$ transistor M11*j* may be controlled by a first control signal CS1, as illustrated in FIG. 8. As shown in FIG. 9, in embodiments of the invention, the $11^{th}$ transistor M11*j* may be turned on during the second period of the one horizontal period 1H and may be turned off during the first period of the one horizontal period 1H via the first control signal CS1. The data signal DSj may be supplied to the data line Dj during the second period of the one horizontal period 1H. In embodiments of the invention, the data signal DS may only be supplied to the data line Dj during the second period of the one horizontal period and may not be supplied during the first period or other period(s).

The current sink unit 280*j* may include $12^{th}$ and $13^{th}$ transistors M12*j* and M13*j*, a current source Imaxj and a third capacitor C3*j*. The current source Imaxj may be connected to a first electrode of the $13^{th}$ transistor M13*j*. The third capacitor C3*j* may be connected between a third node N3*j* and a ground voltage source GND. The $12^{th}$ and $13^{th}$ transistors M12*j* and M13*j* may be controlled by a second control signal CS2. A first electrode of the $12^{th}$ transistor M12 may also be connected to the third node N3*j*.

A gate electrode of the $12^{th}$ transistor M12*j* may be connected to a gate electrode of the $13^{th}$ transistor M13*j*. The gate electrodes of the $12^{th}$ and $13^{th}$ transistors M12*j*, M13*j* may receive the second control signal CS2. A second electrode of the $12^{th}$ transistor M12*j* may be connected to a second electrode of the $13^{th}$ transistor M13*j* and the data line Dj. The first electrode of the $12^{th}$ transistor M12*j* may be connected to the second buffer 260*j*. The $12^{th}$ transistor M12*j* may be turned on during the first period of the one horizontal period 1H by the second control signal CS2 and may be turned off during the second period of the one horizontal period 1H.

The gate electrode of the $13^{th}$ transistor M13*j* may be connected to the gate electrode of the $12^{th}$ transistor M12*j* and the second electrode of the $13^{th}$ transistor may be connected to the data line Dj. The first electrode of the $13^{th}$ transistor M13*j* may be connected to the current source Imaxj. The $13^{th}$ transistor M13*j* may be turned on by the second control signal CS2 during the first period of the one horizontal period 1H and may be turned off during the second period of the one horizontal period 1H.

During the first period when the $12^{th}$ and $13^{th}$ transistors M12*j* and M13*j* may be turned on, the current source Imaxj may receive, from the respective pixel 140*nj*, the minimum current that may be required by the OLED to enable the pixel 140*nj* to emit light with the maximum brightness.

The third capacitor C3*j* may store the compensation voltage applied to the third node N3*j* when the current is being supplied by the respective pixel 140*nj* to the current source Imaxj. The third capacitor C3*j* may charge the compensation voltage applied to the third node N3*j* during the first period and may maintain the compensation voltage of the third node N3*j* uniform even if the $12^{th}$ and $13^{th}$ transistors M12*j* and M13*j* may be turned off.

The second buffer 260*j* may transmit the compensation voltage applied to the third node N3*j* to the voltage generator 240*j*. In particular, the second buffer 260*j* may transmit the voltage charged in the third capacitor C3*j* to the voltage generator 240*j*. The voltage generator 240*j* may divide the voltage between the voltage of the reference voltage Vref supplied by the reference power source ELVref and the compensation voltage supplied from the second buffer 260*j*. The compensation voltage applied to the third node N3*j* may be set based on the electron mobility and/or threshold voltages of the transistors respectively included in those pixels of the pixels 140 associated with the j-th data line Dj. The compensation voltage supplied to the j voltage generators 2401 to 240*j* may be determined by the pixel 140*nj* currently receiving the respective data signal DSj via data line Dj.

In embodiments of the invention in which different compensation voltages are supplied to the j voltage generators 2401 to 240*j*, the values of the gray scale voltages V0 to V$2^k$−1 supplied to the DACs 2501 to 250*j* provided in the j channels may be set to be different from each other. In embodiments of the invention, the gray scale voltages V0 to V$2^k$−1 may be controlled by the pixels 140 connected to the data lines D1 to Dj and the pixel unit 130 may display images having uniform brightness even when the electron mobility of the transistors included in the pixels 140 is not uniform. In embodiments of the invention, the pixels 140 may emit light of maximum brightness when the highest of the gray scale voltages V0 to V$2^k$−1 is employed as the respective data signal DS.

FIG. 9 illustrates exemplary driving waveforms that may be supplied to the switching unit 290*j*, the current sink unit 280*j* and the pixel 140*nj* illustrated in FIG. 8.

Processes for controlling the respective voltages of the data signals DS supplied to the pixels 140 will be described in detail with reference to FIGS. 8 and 9. In the exemplary embodiment illustrated in FIG. 8, the pixel 140*nj* and the pixel circuit 142*nj*, according to the exemplary embodiment illustrated in FIG. 3 is provided. In the following description, the same reference numerals employed above in the description of the nm-th pixel 140*nm* shown in FIG. 3 will be employed to describe like features in the exemplary embodiment of the nj-th pixel 140*nj* illustrated in FIG. 8.

First, the scan signal SSn−1 may be supplied to the n−1th scan line Sn−1. When the scan signal SSn−1 is supplied to the n−1th scan line Sn−1, the third and fifth transistors M3*nj* and M5*nj* may be turned on. The voltage value obtained by subtracting the threshold voltage of the fourth transistor M4*nj* from the first power source ELVDD may then be applied to a second node N2*nj* and the voltage of the reference power source ELVref may be applied to a first node N1*nj*. The voltage corresponding to the voltage drop of the first power source ELVDD and the threshold voltage of the fourth transistor M4*nj* may then be charged in the second capacitor C2*nj*.

The voltages applied to the first node N1*nj* and the second node N2*nj* may be represented by EQUATION1 and EQUATION2.

$$V_{N1}=Vref \quad \text{[EQUATION1]}$$

$$V_{N2}=ELVDD-|V_{thM4}| \quad \text{[EQUATION2]}$$

In EQUATION1 and EQUATION2, $V_{N1}$, $V_{N2}$, and $V_{thM4}$ represent the voltage applied to the first node N1*nj*, the voltage applied to the second node N2*nj*, and the threshold voltage of the fourth transistor M4*nj*, respectively.

From the time when the scan signal SSn−1 is supplied to the n−1th scan line Sn−1 is turned off to the time when the scan signal SSn is supplied to the nth scan line Snj, the first and second nodes N1*nj* and N2*nj* may be floating. Therefore, the voltage value charged in the second capacitor C2*nj* may not change during that time.

The n-th scan signal SSn may then be supplied to the nth scan line Sn so that the first and second transistors M1*nj* and M2*nj* may be turned on. When the scan signal SSn is being supplied to the nth scan line Sn, during the first period of the one horizontal period when the n-th scan line Sn is being driven, the $12^{th}$ and $13^{th}$ transistors M12*j* and M13*j* may be turned on. When the $12^{th}$ and $13^{th}$ transistors M12*j* and M13*j* are turned on, the current that may flow through the current source Imaxj via the first power source ELVDD, the fourth transistor M4*nj*, the second transistor M2*nj*, the data line Dj, and the $13^{th}$ transistor M13*j* may sink.

When current flows through the current source Imaxj via the first power source ELVDD, the fourth transistor M4*nj* and the second transistor M2*nj*, EQUATION3 may apply.

$$I_{max}=\frac{1}{2}\mu_p C_{ox}\frac{W}{L}(ELVDD-V_{N2}-|V_{thM4})^2| \quad \text{[EQUATION3]}$$

In EQUATION3, μ, Cox, W, and L represent the electron mobility, the capacitance of an oxide layer, the width of a channel, and the length of a channel, respectively.

The voltage applied to the second node N2*nj* when the current obtained by EQUATION3 flows through the fourth transistor M4*nj* may be represented by EQUATION4.

$$V_{N2}=ELVDD-\sqrt{\frac{2Imax}{\mu_p C_{ox}}\frac{L}{W}}-|V_{thM4}| \quad \text{[EQUATION4]}$$

The voltage applied to the first node N1*nj* may be represented by EQUATION5 by the coupling of the second capacitor C2*nj*.

$$V_{N1}=Vref-\sqrt{\frac{2Imax}{\mu_p C_{ox}}\frac{L}{W}}=V_{N3}=V_{N4} \quad \text{[EQUATION5]}$$

In EQUATION5, the voltage $V_{N1}$ may correspond to the voltage applied to the first node N1*nj*, the voltage $V_{N3}$ may correspond to the voltage applied to the third node N3*j* and the voltage $V_{N4}$ may correspond to the voltage applied to a fourth node N4*j*. In embodiments of the invention, the voltage $V_{N1}$ applied to the first node N1*nj* may be equal to the voltage $V_{N3}$ applied to the third node N3 and the voltage $V_{N4}$ applied to the fourth node N4*j*. When the current is being supplied to the current source Imaxj, the voltage value obtained by EQUATION5 may be applied to the fourth node N4*j*.

As seen in EQUATION5, the voltage applied to the third node N3*j* and the fourth node N4*j* may be affected by the electron mobility of the transistors included in the pixel 140*nj*, which is supplying current to the current source Imaxj. Therefore, the voltage value applied to the third node N3*j* and the fourth node N4*j* when the current is being supplied to the current source Imaxj may vary in each of the pixels 140 (when the electron mobility varies in each of the pixels 140).

On the other hand, when the voltage obtained by EQUATION5 is applied to the fourth node N4*j*, the voltage $V_{diff}$ of the voltage generator 240*j* may be represented by EQUATION6.

$$V_{diff} = Vref - \left(Vref - \sqrt{\frac{2Imax}{\mu_p C_{OX}}\frac{L}{W}}\right) \quad \text{[EQUATION6]}$$

When the DAC 250*j* selects the hth gray scale voltage among f gray scale voltages in response to the data DATA, the voltage Vb supplied to the first buffer 270*j* may be represented by EQUATION7. In EQUATION7, h may be a natural number equal to or less than f and f may be a natural number.

$$Vb = Vref - \frac{h}{f}\sqrt{\frac{2Imax}{\mu_p C_{OX}}\frac{L}{W}} \quad \text{[EQUATION7]}$$

In embodiments of the invention in which current sink corresponding to a minimum amount of current required by the respective light emitting material/device for displaying light of a maximum brightness sinks to the respective current source during the first period, after the current sinks during the first period, the voltage Vb obtained by EQUATION5 may be charged and supplied to the first buffer 270*j*. During the second period, the $12^{th}$ and $13^{th}$ transistors M12*j* and M13*j* may be turned off, and the $11^{th}$ transistor M11*j* may be turned on. During this time, the third capacitor C3*j* may maintain the voltage amount charged therein and, therefore, the voltage value of the third node N3*j* may be maintained, as illustrated in EQUATION5.

In embodiments of the invention, the $11^{th}$ transistor M11 may be turned on during the second period and the voltage supplied to the first buffer 270*j* may be supplied to the first node N1*nj* via the $11^{th}$ transistor M11*j*, the data line Dj, and the first transistor M11*nj*. In such embodiments of the invention, the voltage obtained by EQUATION7 may be supplied to the first node N1*nj*. The voltage applied to the second node N2*nj* by the coupling of the second capacitor C2*nj* may be represented by EQUATION8.

$$V_{N2} = ELVDD - \frac{h}{f}\sqrt{\frac{2Imax}{\mu_p C_{OX}}\frac{L}{W}} - |V_{thM4}| \quad \text{[EQUATION8]}$$

In embodiments of the invention, the current flowing via the fourth transistor M4*nj* may be represented by EQUATION9.

$$I_{N4} = \frac{1}{2}\mu_p C_{OX}\frac{W}{L}(ELVDD - V_{N2} - |V_{thM4}|)^2 \quad \text{[EQUATION9]}$$

-continued $$= \frac{1}{2}\mu_p C_{OX}\frac{W}{L}\left(ELVDD - \left(ELVDD - \frac{h}{f}\sqrt{\frac{2Imax}{\mu_p C_{OX}}\frac{L}{W}} - |V_{thM4}|\right) - V_{thM4}\right)^2$$

$$= \left(\frac{h}{f}\right)^2 Imax$$

Referring to EQUATION9, in embodiments of the invention, the current flowing through the fourth transistor M4*nj* may be determined by the gray scale voltage generated by the voltage generator 240*j*. In embodiments of the invention, the current corresponding to the gray scale voltage selected by the DAC 250*j* may flow to the fourth transistor M4*nj* irrespective of the threshold voltage and electron mobility of the fourth transistor M4*nj*. As discussed above, embodiments of the invention enable the display of images with uniform brightness.

In embodiments of the invention, as discussed above, different switching units may be employed. FIG. 10 illustrates the connection scheme illustrated in FIG. 8 employing another embodiment of a switching unit 291*j*. The exemplary connection scheme illustrated in FIG. 10 is substantially the same as the exemplary connection scheme illustrated in FIG. 8, but for another exemplary embodiment of the switching unit 291*j*. In the following description, the same reference numerals employed above will be employed to describe like features in the exemplary embodiment illustrated in FIG. 10.

As shown in FIG. 10, another exemplary switching unit 291*j* may include $11^{th}$ and $14^{th}$ transistors M11*j*, M14*j* that may be connected to each other in the form of a transmission gate. The $14^{th}$ transistor M14*j*, which may be a PMOS type transistor, may receive the second control signal CS2. The $11^{th}$ transistor M11*j*, which may be a NMOS type transistor, may receive the first control signal CS1. In such embodiments, when the polarity of the first control signal CS1 is opposite to the polarity of the second control signal CS2, the $11^{th}$ and $14^{th}$ transistors M11*j* and M14*j* may be turned on and off at the same time.

In embodiments of the invention in which the $11^{th}$ and $14^{th}$ transistors M11*j* and M14*j* are connected to each other in the form of the transmission gate, a voltage-current characteristic curve may be in the form of a straight line and switching error may be minimized.

Figure 11:
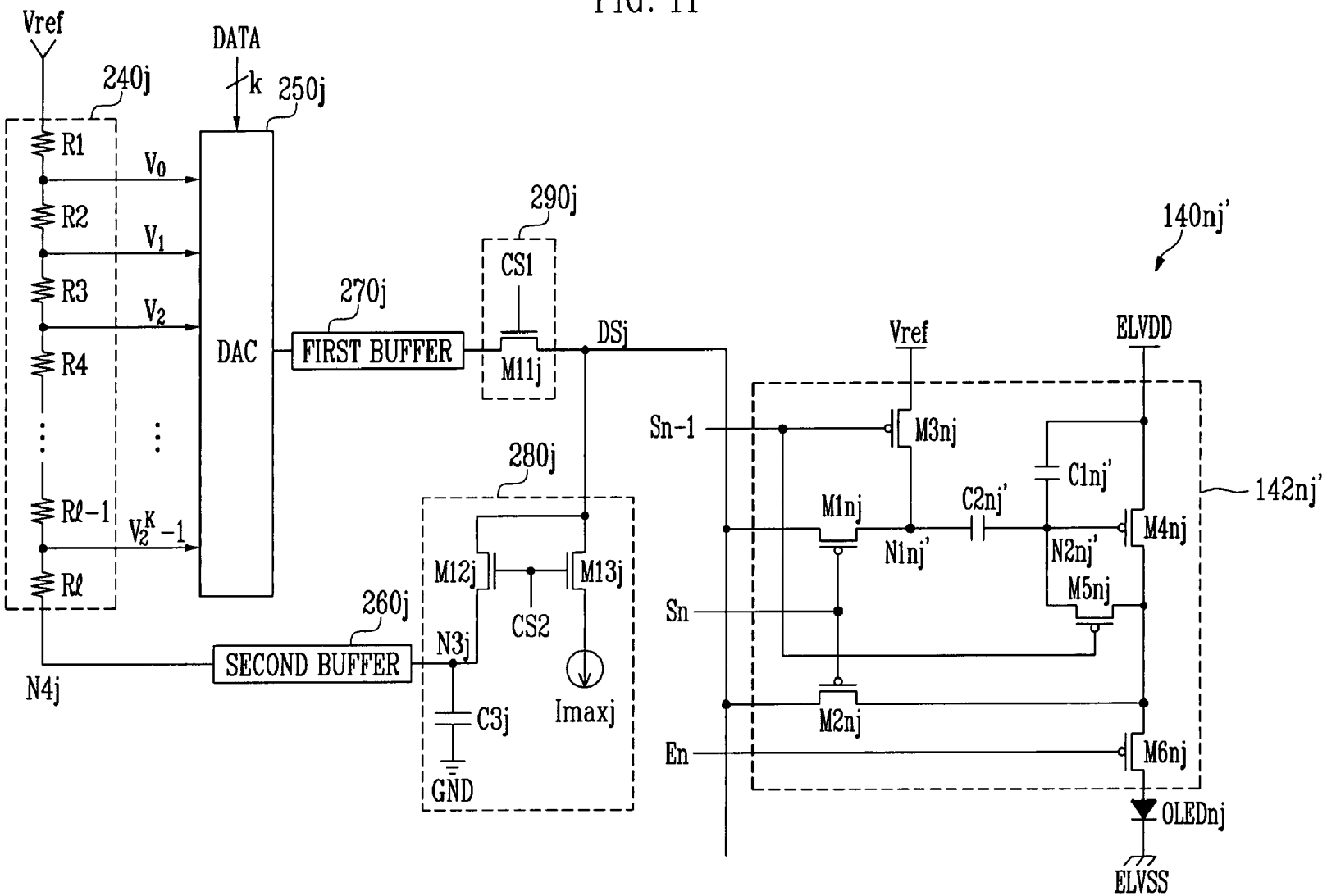
FIG. 11 illustrates a schematic diagram of a second embodiment of a connection scheme connecting the voltage generator, the digital-analog converter, the first buffer, the second buffer, the switching unit and the current sink unit illustrated in FIG. 6, and the pixel illustrated in FIG. 5.

FIG. 11 illustrates a second exemplary embodiment of a connection scheme for connecting voltage generator 240*j*, the DAC 250*j*, the first buffer 270*j*, the second buffer 260*j*, the switching unit 290*j*, the current sink unit 280*j* and the pixel 140 in a specific channel. The exemplary connection scheme illustrated in FIG. 11 is substantially the same as the exemplary connection scheme illustrated in FIG. 8. The exemplary connection scheme illustrate in FIG. 11 employs an exemplary pixel 140*nj*', according to the exemplary pixel 140*nm*' shown in FIG. 5. In the following description, the same reference numerals employed above will be employed to describe like features in the exemplary embodiment illustrated in FIG. 11. Therefore, the signals supplied to/by the pixel 140*nj*' will be only briefly described below.

Referring to FIGS. 9 and 11, when the scan signal SSn−1 is supplied to the n−1th scan line Sn−1, the voltages obtained by EQUATION1 and EQUATION2 may be respectively applied to the first and second nodes N1*nj*' and N2*nj*' of pixel circuit 142*nj*'.

The current that may flow through the fourth transistor M4*nj* during the first period when the scan signal SSn may be supplied to the nth scan line Sn and the $12^{th}$ and $13^{th}$ transistors M12*j* and M13*j* may be turned on may be represented by EQUATION3. The voltage that may be applied to the second node N2*nj*' during the first period when the scan signal SSn is supplied to the nth scan line Sn and the $12^{th}$ and $13^{th}$ transistors M12*j* and M13*j* may be turned on may be represented by EQUATION4.

The voltage applied to the first node N1*nj*' by the coupling of the second capacitor C2*nj* may be represented by EQUATION10.

$$V_{N1} = Vref - \left(\frac{C1 + C2}{C2}\right)\sqrt{\frac{2Imax}{\mu_p C_{ox}}\frac{L}{W}} = V_{N3} = V_{N4} \quad \text{[EQUATION10]}$$

In embodiments of the invention, the voltage applied to the first node N1*nj*' may be supplied to the third node N3*j* and the fourth node N4*j* and the voltage $V_{diff}$ of the voltage generator 240*j* may be represented by EQUATION11.

$$V_{diff} = Vref - \left(Vref - \left(\frac{C1 + C2}{C2}\right)\sqrt{\frac{2Imax}{\mu_p C_{OX}}\frac{L}{W}}\right) \quad \text{[EQUATION11]}$$

When the DAC 250*j* selects the hth gray scale voltage among f gray scale voltages, the voltage Vb supplied to the first buffer 270*j* may be represented by EQUATION12.

$$Vb = Vref - \frac{h}{f}\left(\frac{C1 + C2}{C2}\right)\sqrt{\frac{2Imax}{\mu_p C_{OX}}\frac{L}{W}} \quad \text{[EQUATION12]}$$

The voltage supplied to the first buffer 270*j* may be supplied to the first node N1*nj*'. The voltage applied to the second node N2*nj*' may be represented by EQUATION8. The current that flows through the fourth transistor M4*nj* may be represented by EQUATION9.

In embodiments of the invention, the current supplied to the respective OLEDnj via the fourth transistor M4*nj* may be determined by the gray scale voltage regardless of the threshold voltage and electron mobility of the fourth transistor M4*nj*. Embodiments of the invention enable images with uniform brightness to be displayed.

In some embodiments of the invention, e.g., embodiments employing the pixel 140*nj*' illustrated in FIG. 11, the voltage of the second node N2*nj*' may change gradually although the voltage of the first node N1*nj*' may change rapidly, i.e., (C1+C2)/C2. When the pixel 140*nj*' illustrated in FIG. 11 is employed, a greater voltage range may be set for the voltage generator 240*j* than a voltage range that may be set for the voltage generator 240*j* when the pixel 140*nj* illustrated in FIG. 8 is employed. As discussed above, when the voltage range of the voltage generator 240*j* is set to be larger, it is possible to reduce the influence of the switching error of the $11^{th}$ transistor M11*j* and the first transistor M1*nj*.

In embodiments of the invention, to stably drive the above-described pixels 140, the generated compensation voltage should be stably applied to the pixels. More particularly, for example, the generated compensation voltage should be stably applied to the third node N3 during the first period. However, because the current that sinks during the first period may be a micro current, e.g., several tens of μA, a desired compensation voltage may not be applied during the first period of the one horizontal period. If the first period of the one horizontal period is set to be large enough to solve such a problem, the second period may be shortened. Such a shortened second period may not allow the pixels 140 to be charged as desired.

Figure 12:
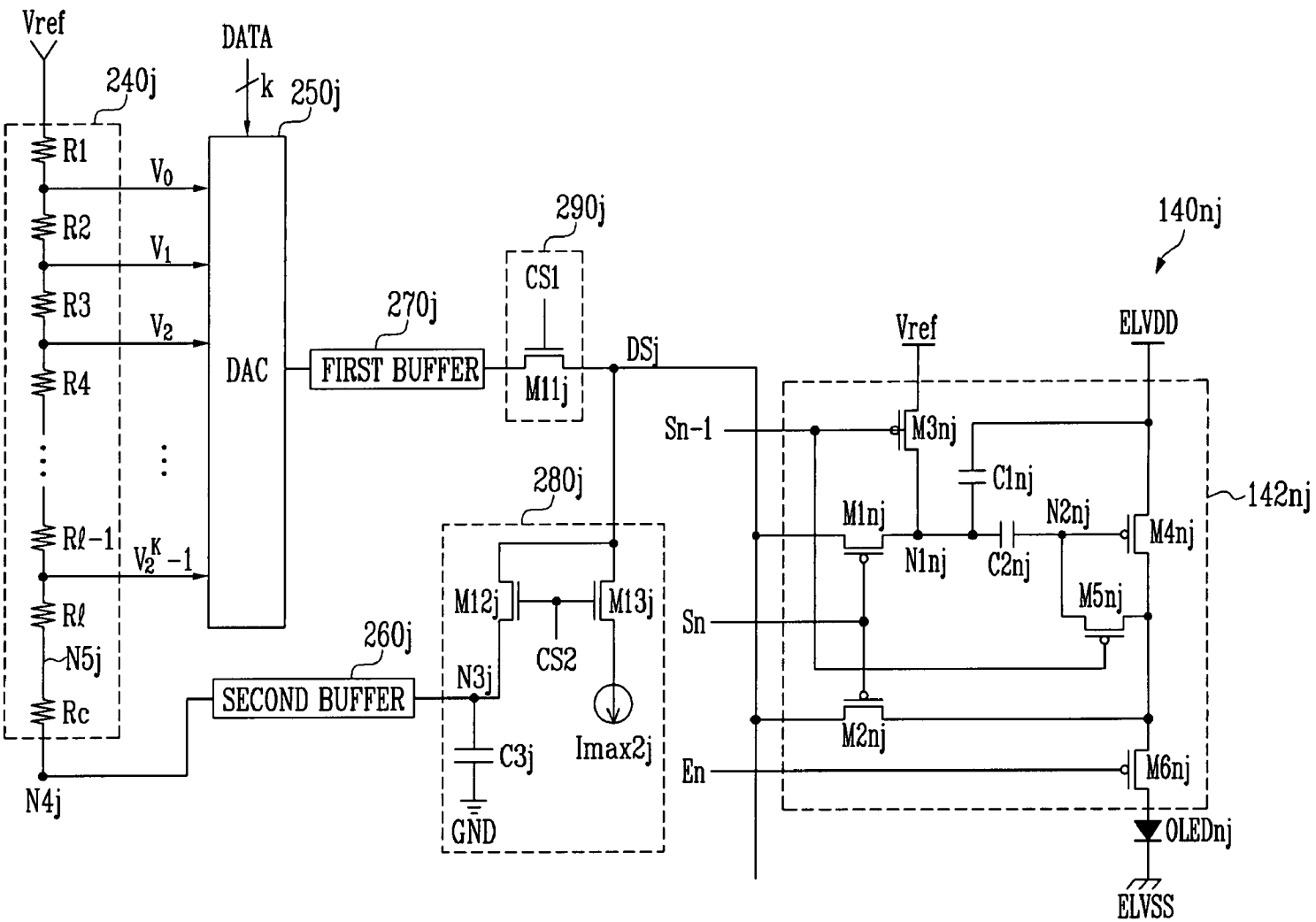
FIG. 12 illustrates a schematic diagram of a third embodiment of a connection scheme connecting the voltage generator, the digital-analog converter, the first buffer, the second buffer, the switching unit and the current sink unit illustrated in FIG. 6, and the pixel illustrated in FIG. 3.

In embodiments of the invention, as illustrated in FIG. 12, a current source Imax2 for sinking current higher than the current to be supplied to the OLED for the pixel 140 to emit light with the maximum brightness may be provided. The current source Imax2*j* may be provided in the current sink unit 280*j*. FIG. 12 illustrates the connection scheme illustrated in FIG. 8 employing the current source Imax2*j*. The exemplary connection scheme illustrated in FIG. 12 is substantially the same as the exemplary connection scheme illustrated in FIG. 8, except for the current source Imax2 replacing Imax, and another exemplary embodiment of a voltage generator 240*j*'. In the following description, the same reference numerals employed above will be employed to describe like features in the exemplary embodiment illustrated in FIG. 12.

FIG. 12 illustrates another exemplary embodiment of a connection scheme among the voltage generator 240*j*', the DAC 250*j*, the first buffer 270*j*, the second buffer 260*j*, the switching unit 290*j*, the current sink unit 280*j* and the pixel 140*nj* in a specific channel. In the exemplary embodiment illustrated in FIG. 12, for simplicity, the jth channel is illustrated, and it is assumed that the data line Dj is connected to the pixel 140*nj*. In the following description, the same reference numerals employed above in the description of the exemplary embodiment illustrated in FIG. 8 will be employed to describe like features in the exemplary embodiment of the connection scheme illustrated in FIG. 12.

As shown in FIG. 12, the current sink unit 280*j* may include $12^{th}$ and $13^{th}$ transistors M12*j* and M13*j* that may be controlled by the second control signal CS2, the current source Imax2*j* that may be connected to the first electrode of the $13^{th}$ transistor M13*j*, and a third capacitor C3*j* that may be connected between a third node N3*j* and a ground voltage source GND.

The gate electrode of the $12^{th}$ transistor M12*j* may be connected to the gate electrode of the $13^{th}$ transistor M13*j* and the second electrode of the $12^{th}$ transistor M12*j* may be connected to the second electrode of the $13^{th}$ transistor M13*j* and the data line Dj. The first electrode of the $12^{th}$ transistor M12*j* may be connected to the second buffer 260*j*. The $12^{th}$ transistor M12*j* may be turned on during the first period of the one horizontal period 1H by the second control signal CS2 and may be turned off during the second period.

The gate electrode of the $13^{th}$ transistor M13 may be connected to the gate electrode of the $12^{th}$ transistor M12*j* and the second electrode of the $13^{th}$ transistor M13*j* may be connected to the data line Dj. The first electrode of the $13^{th}$ transistor M13*j* may be connected to the current source Imax2*j*. The $13^{th}$ transistor M13*j* may be turned on by the second control signal CS2 during the first period of the one horizontal period 1H and may be turned off during the second period.

The current source Imax2*j* may receive, during the first period for driving the nj-th pixel 140*nj* when the $12^{th}$ and $13^{th}$ transistors M12 and M13 may be turned on, a current higher than a minimum current that may be required by the OLEDnj for the respective nj-th pixel 140*nj* to emit light with maximum brightness. In embodiments of the invention employing the current source Imax2*j*, which may receive the relatively higher, i.e., minimum current relatively greater than the current required by the respective nj-th pixel to emit light with the maximum brightness, it may be possible to reduce a time for which a predetermined voltage may be applied to the third node N3*j* and may thereby reduce driving time of the nj-th pixel 140*nj*.

The third capacitor C3*j* may store the first compensation voltage that is applied to the third node N3*j* by the current source Imax2*j* during the first period for driving the nj-th pixel 140*nj*. More particularly, for example, the third capacitor C3*j* may charge the first compensation voltage applied to the third node N3*j* during the first period and may maintain the first compensation voltage of the third node N3*j* uniform during the second period where the $12^{th}$ and $13^{th}$ transistors M12*j* and M13*j* may be turned off.

In embodiments of the invention, the second buffer 260*j* may supply the first compensation voltage applied to the third node N3*j* to the voltage generator 240*j*'.

The voltage generator 240*j*' may include voltage dividing resistors R1 to Rl for generating the plurality of gray scale voltages V0 to $V2^k-1$ and a compensation resistor Rc for reducing the value of the first compensation voltage.

A compensation resistor Rc may be provided between a fifth node N5*j* and the fourth node N4*j* so that a second compensation voltage lower than the first compensation voltage, which may be applied to the fourth node N4*j*, may be applied to the fifth node N5*j*. The value of the second compensation voltage to be applied at the fifth node N5*j*, may be set, for example, to be equal to the value of the voltage that may be applied to the third node N3*j* when the current sinking to the current source Imax2*j* equals the minimum current required by the OLEDnj to emit light with maximum brightness.

The voltage dividing resistors R1 to Rl may divide the voltage between the voltage of the reference power source ELVref and the second compensation voltage to generate the plurality of gray scale voltages V0 to $V2^k-1$ and may supply the generated gray scale voltages V0 to $V2^k-1$ to the DAC 250*j*.

The DAC 250*j* may select one gray scale voltage among the gray scale voltages V0 to $V2^k-1$ based on the bit values of the data DATA and may supply the selected gray scale voltage to the first buffer 270*j*. In embodiments of the invention, the gray scale voltage selected by the DAC 250*j* may be used as the data signal DSj.

The first buffer 270*j* may transmit the data signal DSj supplied from the DAC 250*j* to the switching unit 290*j*.

The switching unit 290*j* may supply the data signal DS to the data line Dj during the second period. The switching unit 290*j* may refrain from supplying the data signal DS to the data line Dj during the first period of the one horizontal period 1H.

Exemplary methods for operating the n-th pixel circuit 142*nj* of the nj-th pixel 140*nj* of the pixels 140 will be described in detail with reference to FIGS. 9 and 12. When the scan signal SSn−1 is supplied to the n−1th scan line Sn−1, the voltages obtained by EQUATION1 and EQUATION2 may be respectively applied to the first and second nodes N1*nj* and N2*nj*.

Then, when the scan signal SSn is supplied to the nth scan line Sn, the first and second transistors M1*nj* and M2*nj* are turned on. The $12^{th}$ and $13^{th}$ transistors M12*nj* and M13*nj* may be turned on during the first period of the one horizontal period when the scan signal SSn is supplied to the nth scan line Sn. Then, the voltage obtained by EQUATION13 may be applied to the third node N3*j* by the current that is sinking via the current source Imax2*j*.

$$V_{N3} = Vref - \sqrt{\frac{2Imax}{\mu_p C_{ox}} \frac{L}{W}} + \Delta V \qquad \text{[EQUATION13]}$$

When the current sinking to the current source Imax2 corresponds to at least the minimum amount of current the respective OLEDnj requires for the respective pixel 140*nj* to emit light with the maximum brightness, the voltage obtained by EQUATION4 may be applied to the third node N3*j*. However, in the exemplary embodiment illustrated in FIG. 12, because the current sinking to the current source Imax2*j* may be higher than the amount of current the respective OLED requires for the respective pixel 140 to emit light with the maximum brightness sinks, the respective increase in current may be addressed as ΔV, and the voltage obtained by EQUATION13 may be applied to the third node N3*j*.

The voltage applied to the third node N3*j* may be applied to the fourth node N4*j* via the second buffer 260*j*. The compensation resistor Rc may reduce the value of the voltage applied to the fourth node N4*j* by a predetermined value and may supply the reduced voltage to the fifth node N5*j*. The compensation resistor Rc may reduce the value of the voltage by ΔV in EQUATION13 and may supply the voltage obtained by EQUATION5 to the fifth node N5*j*.

When the voltage obtained by EQUATION5 is applied to the fifth node N5, the voltage between the fifth node N5*j* and the reference power source ELVref may be represented by EQUATION6. When the DAC 250*j* selects the hth gray scale voltage among the f gray scale voltages, the voltage Vb supplied to the first buffer 270*j* may be represented by EQUATION7.

Then, the voltage supplied to the first buffer 270*j* may be supplied to the first node N1 during the second period when the $11^{th}$ transistor M11*j* may be turned on. More particularly, in embodiments of the invention, the voltage obtained by EQUATION7 may be supplied to the first node N1*nj*. The voltage applied to the second node N2*nj* may be represented by EQUATION8 by the coupling of the second capacitor C2*nj*. As can be understood from EQUATION9, in embodiments of the invention, the respective current depending on the gray scale voltage may flow to the fourth transistor M4*nj* regardless of the threshold voltage and electron mobility of the fourth transistor M4*nj*.

Figure 13:
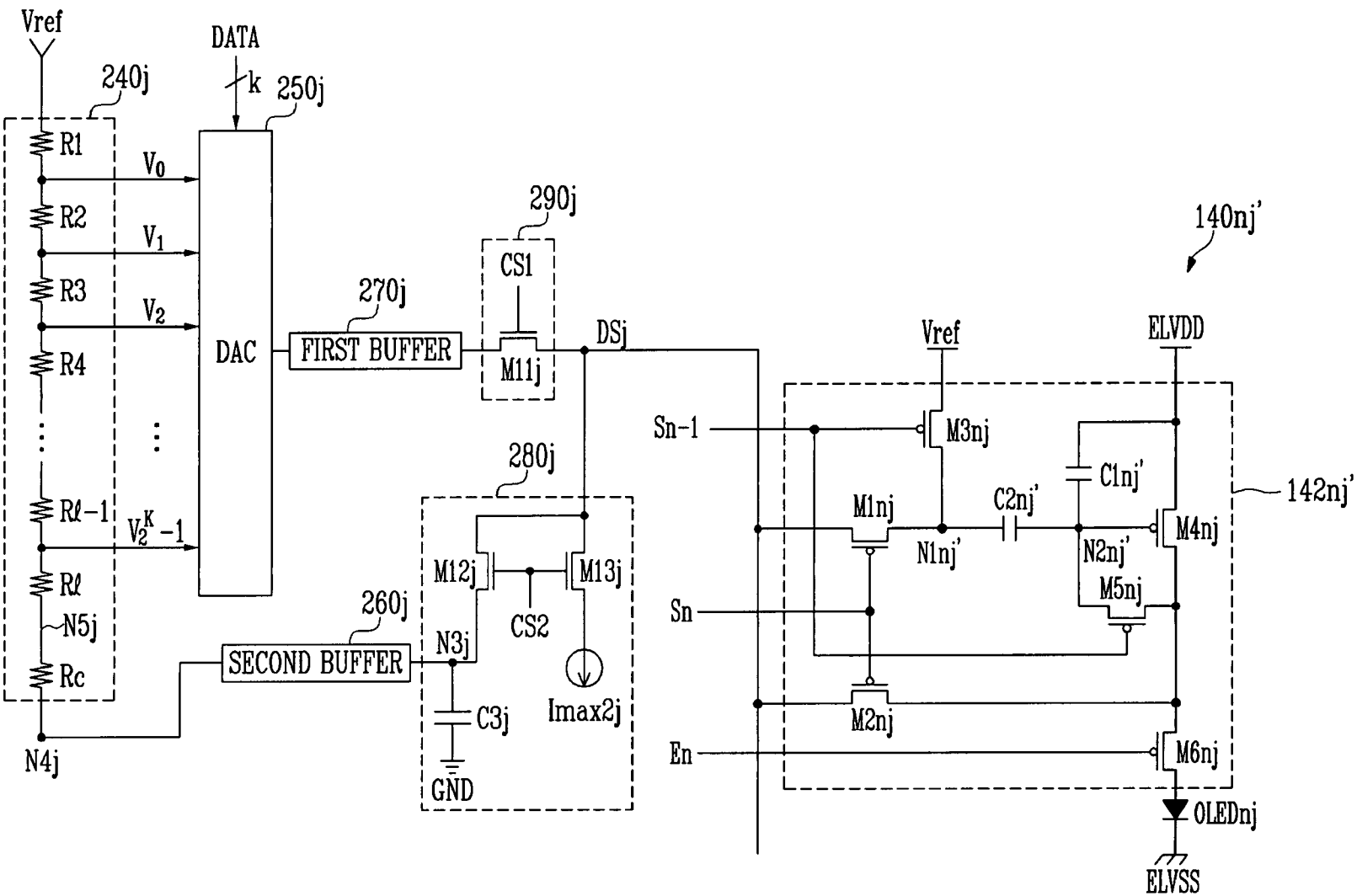
FIG. 13 illustrates a schematic diagram of a fourth embodiment of a connection scheme connecting the voltage generator, the digital-analog converter, the first buffer, the second buffer, the switching unit and the current sink unit illustrated in FIG. 6, and the pixel illustrated in FIG. 5.

FIG. 13 illustrates a fourth embodiment of a connection connecting among the voltage generator 240*j*', the DAC 250*j*, the first buffer 270*j*, the second buffer 260*j*, the switching unit 290*j*, the current sink unit 280*j* and the pixel 140*nj*' in a specific channel. The exemplary embodiment illustrated in FIG. 13 is similar to the exemplary embodiment illustrated in FIG. 12. In particular, in the exemplary embodiment illustrated in FIG. 13, the embodiment of the nm-th pixel 140*nm*' described above with reference to FIG. 5 is employed instead of the exemplary embodiment of the nm-th pixel 140*nm* described above with reference to FIG. 3. Therefore, the voltage supplied to the pixel 140 will be only briefly described below. In embodiments of the invention, the switching unit 291*j* illustrated in FIG. 10 may be employed instead of the one or all of the switching units 290*j* illustrated in FIGS. 12 and 13.

As can be understood from FIGS. 9 and 13, when the scan signal SSn−1 is supplied to the n−1 scan line Sn−1, the voltages obtained by EQUATION1 and EQUATION3 may be respectively applied to the first and second nodes N1*nj* and N2*nj*.

Then, the $12^{th}$ and $13^{th}$ transistors M12*j* and M13*j* may be turned on in the first period of the period where the scan signal SSn is supplied to the nth scan line Sn. The voltage obtained by EQUATION14 may then be applied to the third node N3*j* by the current that is sinking to the current source Imax2*j*.

$$V_{N1} = Vref - \left(\frac{C1 + C2}{C2}\right)\sqrt{\frac{2Imax}{\mu_p C_{ox}}\frac{L}{W}} + \Delta V \quad \text{[EQUATION 14]}$$

In embodiments of the invention in which the current sinking to the current source Imax is the same as the required current flow to the respective light emitting element/material, e.g., OLEDnm, of the respective pixel 140*nm*, 140*nm*' to emit light with the maximum brightness, the voltage obtained by EQUATION10 may be applied to the third node N3*j*. In embodiments of the invention, e.g., the embodiment illustrated in FIG. 13, in which a current flow that is higher than the current flow required by the OLEDnj' for the pixel 140*nj*' to emit light with the maximum brightness may sink to the current source Imax2*j*, the voltage obtained by EQUATION14, accounting for a change in voltage ΔV due to the increased current flow, may be applied to the third node N3*j*.

The voltage applied to the third node N3*j* may be applied to the fourth node N4*j* via the second buffer 260*j*. The compensation resistor Rc may then reduce the value of the voltage applied to the fourth node N4*j* by a predetermined value and may supply the reduced voltage to the fifth node N5*j*. In embodiments of the invention, the compensation resistor Rc may reduce the value of the voltage applied to the fourth node N4*j* by ΔV of EQUATION14 and may supply the voltage obtained by EQUATION10 to the fifth node N5*j*. As discussed above, ΔV may correspond to the voltage difference that may result when a current flow that is different from the current flow required by the OLEDnj for the pixel 140*nj*' to emit light of maximum brightness sinks to the current source Imax2*j*.

When the voltage obtained by EQUATION10 is applied to the fifth node N5*j*, the voltage between the fifth node N5*j* and the reference power source ELVref may be represented by EQUATION11. When the DAC 250*j* selects the hth gray scale voltage among the f gray scale voltages, the voltage Vb supplied to the first buffer 270*j* may be represented by EQUATION12.

Then, the voltage supplied to the first buffer 270*j* may be supplied to the first node N1*nj*' during the second period where the $11^{th}$ transistor M11*j* is turned on. At this time, the voltage applied to the second node N2*nj*' may be represented by EQUATION8. Therefore, the current that flows through the fourth transistor M4*nj* may be represented by EQUATION9. In embodiments of the invention, the current corresponding to the gray scale voltage selected by the DAC 250*j* may flow to the fourth transistor M4*nj* irrespective of the threshold voltage and electron mobility of the fourth transistor M4*nj*. As discussed above, embodiments of the invention enable the display of images with uniform brightness.

As described above, data driving circuits employing one or more aspects of the invention, light emitting display using such data driving circuits, and methods of driving such light emitting displays, enable values of the gray scale voltages generated by the voltage generator to be reset using the compensation voltage generated when the current from the respective pixel sinks. The reset gray scale voltages may then be supplied to the respective pixel, and in embodiments of the invention it is possible to display images with uniform brightness regardless of the electron mobility of the transistors. In embodiments of the invention, because a current flow that is higher than the current flow required by the OLED for the respective pixel to emit light with the maximum brightness may sink to a current source, it is possible to stably drive the light emitting display during each of the horizontal periods.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A data driving circuit for driving a pixel of an organic light emitting display based on externally supplied data for the pixel, wherein the pixel is electrically connectable to the driving circuit via a data line, the data driving circuit comprising:

a current sink, the current sink receiving a predetermined current from the pixel during a first partial period of a complete period for driving the pixel;

a voltage generator, the voltage generator respectively setting values of a plurality of gray scale voltages using a compensation voltage generated by the pixel when the predetermined current is received by the current sink, the compensation voltage being supplied from the current sink to the voltage generator;

a digital-analog converter, the digital-analog converter selecting, as a data signal for driving the pixel during the complete period, one of the plurality of set gray scale voltages based on a bit value of a portion of the externally supplied data associated with the pixel; and at least one switching unit, the switching unit supplying the selected data signal to the data line during any partial period of the complete period elapsing after the first partial period of the complete period, wherein:

a value of the predetermined current being equal to or higher than a value of a minimum current employable by the pixel to emit light of maximum brightness; and the maximum brightness corresponding to a brightness of the pixel when a highest one of the plurality of set gray scale voltages is applied to the pixel.

2. The data driving circuit as claimed in claim 1, wherein the voltage generator comprises a plurality of voltage dividing resistors provided between a first terminal for receiving a reference power source and a second terminal for receiving the compensation voltage from the current sink to set the gray scale voltages.

3. The data driving circuit as claimed in claim 2, further comprising a compensation resistor connected between the second terminal and the voltage dividing resistors to reduce a value of the compensation voltage, wherein the compensation resistor compensates for the value of the predetermined current being higher than the value of the minimum current employable by the pixel to emit light of maximum brightness by reducing the value of the compensation voltage such that a voltage corresponding to the minimum current is supplied to the voltage dividing resistors.

4. The data driving circuit as claimed in claim 2, wherein the current sink receives the predetermined current from the pixel during the first partial period of one complete horizontal period for driving the pixel based on the selected gray scale voltage, the first partial period occurring before a second partial period in the one complete horizontal period in which the switching unit supplies the selected date signal to the date line.

5. The data driving circuit as claimed in claim 4, wherein the current sink comprises:

a current receiving unit for receiving the predetermined current;

a first transistor provided between the data line and the voltage generator, the first transistor being turned on during the first partial period;

a second transistor provided between the data line and the current receiving unit, the second transistor being turned on during the first partial period; and a capacitor for charging the compensation voltage.

6. The data driving circuit as claimed in claim 4, wherein the switching unit comprises at least one transistor for selectively connecting the data line and the digital-analog converter to each other only during any other partial period of a complete period for driving the pixel, which occurs after a first partial period of the complete period.

7. The data driving circuit as claimed in claim 6, wherein the switching unit comprises two transistors that are connected to each other so as to form a transmission gate.

8. The data driving circuit as claimed in claim 1, further comprising:

a first buffer provided between the digital-analog converter and the switching unit; and a second buffer provided between the current sink and the voltage generator.

9. The data driving circuit as claimed in claim 1, wherein each channel of the data driving circuit includes a respective one of each of the current sink, the voltage generator, the digital-analog converter and the switching unit.

10. The data driving circuit as claimed in claim 1, further comprising:

a shift register for generating sampling pulses;

a sampling latch for receiving the data in response to the sampling pulses; and a holding latch for temporarily storing the data stored in the sampling latch before the temporarily stored data is supplied to the digital-analog converter.

11. The data driving circuit as claimed in claim 10, further comprising a level shifter for modifying a voltage level of the data stored in the holding latch before the temporarily stored data is supplied to the digital-analog converter.

12. A light emitting display, comprising:

a pixel unit including a plurality of pixels connected to n scan lines, a plurality of data lines and a plurality of emission control lines;

a scan driver for respectively and sequentially supplying, during each scan cycle, n scan signals to the n scan lines, and for sequentially and respectively supplying emission control signals to the plurality of emission control lines; and a data driving circuit, the data driving circuit including current sinks receiving respective predetermined currents from the pixels, the data driving circuit respectively setting values of and generating a plurality of gray scale voltages using respective compensation voltages received from the respective current sinks and generated by the pixels when the respective predetermined currents are received by the respective current sinks during a first partial period of a complete period for driving at least one of the pixels, and the data driving circuit respectively selecting and supplying one of the plurality of gray scale voltages as a data signal for driving the respective pixels during any partial period of the complete period elapsing after the first partial period of the complete period, wherein respective values of the predetermined currents are equal to or greater than a value of a minimum current employable by the respective pixel to emit light of maximum brightness.

13. The light emitting display as claimed in claim 12, wherein each of the pixels is connected to two of the n scan lines, and during each of the scan cycles, a first scan line of the two scan lines receiving a respective one of the n scan signals before a second scan line of the two scan lines receives a respective one of the n scan signals, and each of the pixels comprises:

a first power source;

an organic light emitting diode, the organic light emitting diode receiving current from the first power source;

first and second transistors each having a first electrode connected to the respective one of the data lines associated with the pixel, the first and second transistors being turned on when the first of the two scan signals is supplied;

a third transistor having a first electrode connected to a reference power source and a second electrode connected to a second electrode of the first transistor, the third transistor being turned on when the first of the two scan signals is supplied;

a fourth transistor, the fourth transistor controlling an amount of current supplied to the organic light emitting diode, a first terminal of the fourth transistor being connected to the first power source; and a fifth transistor having a first electrode connected to a gate electrode of the fourth transistor and a second electrode connected to a second electrode of the fourth transistor, the fifth transistor being turned on when the first of the two scan signals is supplied such that the fourth transistor operates as a diode.

14. The light emitting display as claimed in claim 13, wherein each of the pixels comprises:

a first capacitor having a first electrode connected to one of a second electrode of the first transistor and the gate electrode of the fourth transistor and a second electrode connected to the first power source; and a second capacitor having a first electrode connected to the second electrode of the first transistor and a second electrode connected to the gate electrode of the fourth transistor.

15. The light emitting display as claimed in claim 13, wherein each of the pixels further comprises a sixth transistor having a first terminal connected to the second electrode of the fourth transistor and a second terminal connected to the organic light emitting diode, the sixth transistor being turned off when the respective emission control signal is supplied, wherein the current sink in the data driving circuit receives the predetermined current from the pixel during the first partial period of the complete period for driving the pixel based on the selected gray scale voltage, the first partial period occurring before a second partial period of the complete period for driving the pixel based on the selected gray scale voltage, and the sixth transistor is turned on during the second partial period of the complete period for driving the pixel.

16. A method of driving a pixel of a light emitting display based on externally supplied data for the pixel, wherein the pixel is electrically connectable to a driving circuit via a data line, the method comprising:

flowing a predetermined current from the pixel to a current sink of the light emitting display during a first partial period of a complete period for driving the pixel, a value of the predetermined current being equal to or greater than a value of a minimum current employable by the pixel to emit light of maximum brightness;

generating a compensation voltage when the predetermined current flows to the current sink;

setting values of and generating a plurality of gray scale voltages using the generated compensation voltage supplied from the current sink;

selecting, as a data signal for driving the pixel during the complete period, one of the plurality of gray scale voltages based on a bit value of a portion of the externally supplied data associated with the pixel; and supplying the selected data signal to the pixel via the data line during any partial period of the complete period elapsing after the first partial period of the complete period, wherein the maximum brightness corresponds to a brightness of the pixel when a highest one of the plurality of reset gray scale voltages is applied to the pixel.

17. The method as claimed in claim 16, wherein flowing the predetermined current and generating the compensation voltage occur during the first partial period of a complete period for driving the pixel based on the selected gray scale voltage.

18. The method as claimed in claim 17, wherein the complete period is a complete horizontal period for driving the pixel.

19. The method as claimed in claim 16, wherein when the value of the predetermined current flowing from the pixel to the current sink of the light emitting display is greater than the value of the minimum current employable by the respective pixel to emit light of maximum brightness, generating the compensation voltage includes generating an initial compensation voltage and a first compensation voltage based on the initial compensation voltage before the step of setting values of the plurality of gray scale voltages.

20. The method as claimed in claim 19, wherein:

the first compensation voltage is less than the initial compensation voltage and the first compensation voltage corresponds to a highest one of the plurality of gray scale voltages, and the compensation voltage generated when the predetermined current flows to the current sink is equal to the minimum current employable by the pixel to emit light of maximum brightness.

21. The method as claimed in claim 16, wherein the step of setting values of the plurality of gray scale voltages comprises supplying the compensation voltage to a plurality of voltage dividing resistors.

22. A data driving circuit employable by a light emitting display for driving a pixel of the light emitting display based on externally supplied data for the pixel, the pixel being electrically connectable to a data line, at least one scan line and an emission line of the light emitting display, the data driving circuit comprising:

means for sinking a predetermined current received from the pixel via the data line during a first partial period of a complete period for driving the pixel, means for receiving a compensation voltage generated by the pixel when the predetermined current is received by the means for sinking the predetermined current;

means for generating and setting values for a plurality of gray scale voltages using the compensation voltage, the compensation voltage being supplied from the means for receiving the compensation voltage to the means for generating and setting values;

means for selecting, as a data signal for driving the pixel during the complete period, one of the plurality of set gray scale voltages based on a bit value of a portion of the externally supplied data associated with the pixel; and means for supplying the selected data signal to the data line during any partial period of the complete period elapsing after the first partial period of the complete period, when a value of the predetermined current is equal to or higher than a value of a minimum current employable by the pixel to emit light of maximum brightness, and the maximum brightness corresponds to a brightness of the pixel when a highest one of the plurality of set gray scale voltages is applied to the pixel.

* * * * *